United States Patent [19]

Kato et al.

[11] Patent Number: 5,073,467

[45] Date of Patent: Dec. 17, 1991

[54] ELECTROPHOTOGRAPHIC PHOTORECEPTOR

[75] Inventors: Eiichi Kato; Kazuo Ishii, both of Shizuoka, Japan

[73] Assignee: Fuji Photo Film Co., Ltd., Kanagawa, Japan

[21] Appl. No.: 420,505

[22] Filed: Oct. 11, 1989

[30] Foreign Application Priority Data

Oct. 12, 1988 [JP] Japan ..... 63-254786
Nov. 17, 1988 [JP] Japan ..... 63-288973

[51] Int. Cl.[5] ..... G03G 5/087

[52] U.S. Cl. ..... 430/87; 430/49; 430/96; 525/191; 525/220; 525/222; 525/227; 525/235

[58] Field of Search ..... 430/96, 49, 87

[56] References Cited

U.S. PATENT DOCUMENTS 4,952,475 8/1990 Kato et al. ..... 430/96
4,954,407 9/1990 Kato et al. ..... 430/96
4,968,572 11/1990 Kato et al. ..... 430/96

FOREIGN PATENT DOCUMENTS 0282275 9/1988 European Pat. Off. ..... 430/96
0307227 3/1989 European Pat. Off. ..... 430/96
220148 9/1988 Japan ..... 430/96
211766 8/1989 Japan ..... 430/96

*Primary Examiner*—Roland Martin
*Attorney, Agent, or Firm*—Sughrue, Mion, Zinn, Macpeak & Seas

[57] ABSTRACT

An electrophotographic photoreceptor comprising a support having provided thereon at least one photoconductive layer containing at least inorganic photoconductive particles and a binder resin, wherein the binder resin comprises (A) at least one resin having a weight average molecular weight of from $1\times10^3$ to $2\times10^4$ with at least one substituent selected from the group consisting of (i) $-PO_3H_2$, (ii) $-SO_3H$, (iii) $-COOH$, (iv)

and (B) at least one copolymer resin comprising a monofunctional macromonomer and a monomer, said monofunctional macromonomer having a weight average molecular weight of not more than $2\times10^4$, said macromonomer containing at least one polymerization component represented by formula (b-2) or (b-3):

(b-2)

(b-3)

with a polymerizable double bond-containing group represented by formula (b-1) being bonded to only one of terminals of the main chain thereof, (b-1)

and said monomer is represented by formula (b-4):

(b-4)

The photoreceptor exhibits excellent electrostatic characteristics, image formation as well as printing suitability irrespective of variations in environmental conditions or the kind of sensitizing dyes used in combination with the photoreceptor.

11 Claims, No Drawings

ELECTROPHOTOGRAPHIC PHOTORECEPTOR

FIELD OF THE INVENTION

This invention relates to an electro-photographic photoreceptor, and more particularly to an electrophotographic photoreceptor having excellent electrostatic characteristics, moisture resistance, and, especially, performance properties as a CPC photoreceptor.

BACKGROUND OF THE INVENTION

An electrophotographic photoreceptor may have various structures depending on the characteristics required or electrophotographic processes to be employed.

A system in which a photoreceptor comprises a support having thereon at least one photoconductive layer and, if necessary, an insulating layer on the surface thereof is widely employed. The photoreceptor comprising a support and at least one photoconductive layer is subjected to ordinary electrophotographic processing for image formation including charging, imagewise exposure, development and, if desired, transfer.

Electrophotographic photoreceptors have also been used widely as offset printing plate precursors for direct printing plate making. In particular, a direct electrophotographic lithographic printing system has recently been acquiring a greater importance as a system providing hundreds to thousands of prints of high image quality.

Binders which are used in the photoconductive layer should themselves have film-forming properties and the capability of dispersing photoconductive particles therein. Also, when formulated into a photoconductive layer, the binders should have satisfactory adhesion to a support. They also must have various electrostatic characteristics and image-forming properties, such that the photoconductive layer exhibits excellent electrostatic capacity, small dark decay and large light decay, hardly undergoes fatigue before exposure, and maintains these characteristics in a stable manner against a change of humidity at the time of image formation.

Binder resins which have been conventionally used include silicone resins (see JP-(-34-6670) (the term "JP-B" as used herein refers to an "examined Japanese patent publication"), styrene-butadiere resins (see JP-B-35-1960), alkyd resins, maleic acid resins and polyamides (see JP-B-35-11219), vinyl acetate resins (see JP-B-41-2425), vinyl acetate copolymer resins (see JP-B-41-2426), acrylic resins (see JP-B-35-11216), acrylic ester copolymer resins (see JP-B-35-11219, JP-B-36-8510 and JP-B-41-13946), etc. However, electrophotographic photosensitive materials using these known resins have a number of disadvantages, i.e., poor affinity for photoconductive particles (poor dispersion of a photoconductive coating composition); low photoconductive layer charging properties; poor reproduced image quality, particularly dot reproducibility or resolving power; susceptibility of the reproduced image quality to influences from the environment at the time of electrophotographic image formation, such as high temperature and high humidity conditions or low temperature and low humidity conditions; and the like.

To improve the electrostatic characteristics of a photoconductive layer, various approaches have hitherto been taken. For example, incorporation of a compound containing an aromatic ring or a furan ring containing a carboxyl group or a nitro group, either alone or in combination with a dicarboxylic acid anhydride into a photoconductive layer has been proposed as disclosed in JP-B-42-6878 and JP-B-45-3073. However, the thus improved photosensitive materials still have insufficient electrostatic characteristics, particularly, light decay characteristics. The insufficient sensitivity of these photosensitive materials has been compensated for by incorporating a large quantity of a sensitizing dye into the photoconductive layer. However, photosensitive materials containing a large quantity of a sensitizing dye undergo a considerable whiteness deterioration, which means reduced quality as a recording medium, sometimes causing a deterioration in dark decay characteristics, resulting in a failure to obtain a satisfactory reproduced image.

On the other hand, JP-A-60-10254 (the term "JP-A" as used herein refers to a "published unexamined Japanese patent application") suggests control of the average molecular weight of a resin to be used as a binder of the photoconductive layer. According to this suggestion, the combined use of a acrylic resin having an acid value of from 4 to 50 whose average molecular weight is distributed within two ranges, i.e., a range of from $1\times10$ to $1\times10^4$ and a range of from $1\times10^4$ and $2\times10^5$, would improve the electrostatic characteristics, particularly reproducibility, as a PPC photoreceptor on repeated use, moisture resistance, and the like.

In the field of lithographic printing plate precursors, extensive studies have been conducted to provide binder resins for a photoconductive layer having electrostatic characteristics compatible with printing characteristics. Examples of binder resins so far reported to be effective for oil desensitization of a photoconductive layer include a resin having a molecular weight of from $1.8\times10^4$ to $10\times10^4$ and a glass transition point of from 10° C. to 80° C. obtained by copolymerizing a (meth)acrylate monomer and a copolymerizable monomer in the presence of fumaric acid in combination with a copolymer of a (meth)acrylate monomer and a copolymerizable monomer other than fumeric acid as disclosed in JP-B-50-31011; a terpolymer containing a (meth)acrylic ester unit with a substituent having a carboxyl group at least 7 atoms distant from the ester linkage as disclosed in JP-A-53-54027; a tetra- or pentapolymer containing an acrylic acid unit and a hydroxyethyl (meth)acrylate unit as disclosed in JP-A-54-20735 and JP-A-57-202544; a terpolymer containing a (meth)acrylic ester unit with an alkyl group having from 6 to 12 carbon atoms as a substituent and a vinyl monomer containing a carboxyl group as disclosed in JP-A-58-68046; and the like.

However, none of these resins proposed has proved by actual evaluations to be satisfactory for practical use in charging properties, dark charge retention, photosensitivity, and surface smoothness of the photoconductive layer.

Further, the binder resins proposed for use in electrophotographic lithographic printing plate precursors were also proved by actual evaluations to give rise to problems relating to electrostatic characteristics and background staining of prints.

SUMMARY OF THE INVENTION

An object of this invention is to provide an electrophotographic photoreceptor having improved electrostatic characteristics, particularly dark charge retention and photosensitivity, and improved image reproducibility.

Another object of this invention is to provide an electrophotographic photoreceptor which forms a clear reproduced image of high quality unaffected by variations in environmental conditions at the time of image reproduction, such as a change to low temperature and low humidity conditions or to high temperature and high humidity conditions.

A further object of this invention is to provide a CPC electrophotographic photoreceptor having excellent electrostatic characteristics and small dependence on the environmental conditions.

An even further object of this invention is to provide a lithographic printing plate precursor which provides a lithographic printing plate causing no background stains of prints.

A still further object of this invention is to provide an electrophotographic photoreceptor which is hardly influenced by the kind of sensitizing dyes used in combination.

Yet a further object of this invention is to provide an electrophotographic photoreceptor which forms a clear reproduced image of high quality even when processed by a scanning exposure system utilizing a semiconductor laser beam.

It has now been found that the above objects of this invention can be accomplished by an electrophotographic photoreceptor comprising a support having provided thereon at least one photoconductive layer containing at least inorganic photoconductive particles and a binder resin, wherein the binder resin comprises (A) at least one resin having a weight average molecular weight of from $1\times10^3$ to $2\times10^4$ with at least one substituent selected from the group consisting of (i) $-PO_3H_2$, (ii) $-SO_3H$, (iii) $-COOH$, (iv)

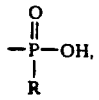

wherein R represents a hydrocarbon group or —OR', and R' represents a hydrocarbon group, (v) -SH, (vi) a phenolic hydroxyl group, and (vii) a cyclic acid anhydride-containing group, said groups (i) to (vii) being bonded to one of terminals of the main chain thereof, and (B) at least one copolymer resin comprising a monofunctional macromonomer and a monomer, said monofunctional macromonomer having a weight average molecular weight of not more than $2\times10^4$, the macromonomer containing at least one polymerization component represented by formula (b-2) or (b-3):

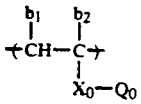

(b-2)

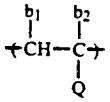

(b-3)

wherein $X_0$ represents —COO—, —OCO—, —$CH_2$OCO—, —$CH_2$COO—, —O—, —$SO_2$—, —CO—,

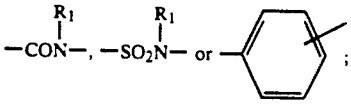

wherein $R_1$ represents a hydrogen atom or a hydrocarbon group; $Q_0$ represents an aliphatic group having from 1 to 18 carbon atoms or an aromatic group having from 6 to 12 carbon atoms; $b_1$ and $b_2$, which may be the same or different, each represents a hydrogen atom, a halogen atom, a cyano group, a hydrocarbon group, or —COO—Z or —COO—Z bonded via a hydrocarbon group, wherein Z represents a hydrogen atom or a substituted or unsubstituted hydrocarbon group; and Q represents —CN, —$CONH_2$ or

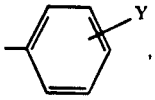

wherein Y represents a hydrogen atom, a halogen atom, an alkoxyl group or —COOZ', wherein Z' represents an alkyl group, an aralkyl group or an aryl group, with a polymerizable double bond-containing group represented by formula (b-1) being bonded to only one of terminals of the main chain thereof,

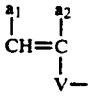

(b-1)

wherein V has the same meaning as $X_0$; and $a_1$ and $a_2$, which may be the same or different, each has the same meaning as $b_1$ and $b_2$, and said monomer is represented by formula (b-4):

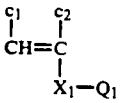

(b-4)

wherein $X_1$ has the same meaning as $X_0$; $Q_1$ has the same meaning as $Q_0$; and $c_1$ and $c_2$, which may be the same or different, each has the same meaning as $b_1$ and $b_2$.

DETAILED DESCRIPTION OF THE INVENTION

Resin (A) is preferably a resin containing at least 30% by weight of at least one repeating unit representing by formula (a-1) or (a-2):

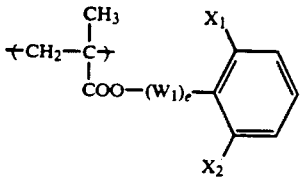

(a-1)

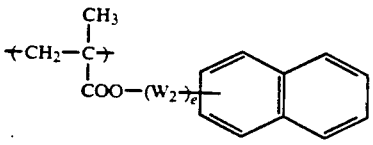

(a-2)

wherein $X_1$ and $X_2$, which may be the same or different, each represents a hydrogen atom, a hydrocarbon group having from 1 to 10 carbon atoms, a chlorine atom, a bromine atom, $—COY_1$ or $—COOY_2$, wherein $Y_1$ and $Y_2$, which may be the same or different, each represents a hydrocarbon group having from 1 to 10 carbon atoms, provided that both $X_1$ and $X_2$ do not simultaneously represent a hydrogen atom; $W_1$ and $W_2$ each represents a linking group containing from 1 to 4 linking atoms which connects the —COO— and the benzene ring, and e is 0 or 1.

Resin (A) is preferably a polymer having at least one substituent selected from $—PO_3H_2$, $—SO_3H$, —COOH,

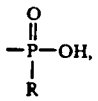

wherein R represents a hydrocarbon group having from 1 to 10 carbon atoms or ≧OR', and R' represents a hydrocarbon group having from 1 to 10 carbon atoms, and a cyclic acid anhydride-containing group, the substituent being bonded to only one of terminals of the polymer main chain.

Resin (B) is preferably a copolymer having at least one acidic group selected from the group consisting of (i) $—PO_3H_2$, (ii) $—SO_3H$, (iii) —COOH, (iv) —OH, (v) —SH, and (vi)

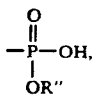

wherein R'' represents a hydrocarbon group, the acidic group being bonded to only one of terminals of the polymer main chain.

The binder resin which can ba used in the present invention comprises at least (A) a low molecular weight resin containing at least one of the above-recited acidic groups and/or cyclic acid anhydride-containing group (hereinafter inclusively referred to as "acidic groups" unless otherwise indicated) not in the side chains but at only one of terminals of the main chain thereof, and (B) a comb type copolymer resin containing at least one Macromonomer (M) and at least one monomer represented by formula (b-4).

In the present invention, the acidic group contained in Resin (A) is adsorbed onto stoichiometrical defects of an inorganic photoconductive substance to sufficiently cover the surface thereof. Thus, electron traps of the photoconductive substance can be compensated for and humidity resistance can be greatly improved, while aiding sufficiently the dispersion of the photoconductive particles without agglomeration. The fact that Resin (A) has a low molecular weight also improves the covering power for the surface of the photoconductive particles. On the other hand, Resin (8) serves to sufficiently heighten the mechanical strength of the photoconductive layer, which may be insufficient in case of using Resin (A) alone.

Further, the photoreceptor according to the present invention has improved surface smoothness. In general, if a photoreceptor to be used as a lithographic printing plate precursor is prepared from a nonuniform dispersion of photoconductive particles in a binder resin with agglomerates being present, the photoconductive layer has a rough surface. As a result, nonimage areas cannot be rendered uniformly hydrophilic by an oil desensitization treatment with an oil-desensitizing solution. This being the case, the resulting printing plate induces adhesion of a printing ink to the nonimage areas on printing, which phenomenon leads to background stains in the nonimage areas of the prints.

Even when only low molecular weight Resin (A) of the present invention is used as a sole binder resin, it is sufficiently adsorbed onto the photoconductive particles to cover the surface of the particles to thereby provide a photoconductive layer smoothness, satisfactory electrostatic characteristics, and stain-free images. However, the resulting photoconductive layer does not exhibit sufficient film strength, failing to give satisfactory results in connection to durability.

In short, a proper adsorption/covering mutual action between the inorganic photoconductive particles and the binder resin and satisfactory film strength of a photoconductive layer cannot be achieved without a combination of Resins (A) and (B).

Resin (B) is preferably a comb type copolymer resin having at least one acidic group selected from the group consisting of $—PO_3H_2$, $—SO_3H$, —COOH, —OH, —SH, and

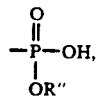

wherein R'' represents a hydrocarbon group, the acidic group being bonded to only one of terminals of the main chain thereof (this preferred Resin (B) will be sometimes referred to Resin (B')).

Use of Resin (B') brings about further improvements in electrostatic characteristics, particularly dark decay retention and photosensitivity without giving any adverse influence on the excellent characteristics obtained by the use of Resin (A). The effects of Resin (B') undergo substantially no variation irrespective of changes of environmental conditions, such as a change to high temperature and high humidity conditions or to low temperature and low humidity conditions. Resin (B') is also effective to further enhance film strength and thereby printing durability.

Resin (A) has a weight average molecular weight of from $1\times10^3$ to $2\times10^4$, preferably from $3\times10^3$ to $1\times10^4$ Resin (A) preferably has a glass transition point of from −10° C. to 100° C., more preferably from −5° C. to 80° C. The content of the acidic group bonded to the terminal(s) in Resin (A) ranges from 0.5 to 15% by weight, preferably from 1 to 10% by weight.

If the molecular weight of Resin (A) is less than $1\times10^3$, the film-forming properties are reduced, and sufficient film strength is not retained. If it exceeds $2\times10^4$, the electrophotographic characteristics, especially initial potential and dark decay retention, are degraded. When, in particular, such a high molecular resin contains more than 3% by weight of an acidic group, deterioration of electrophotographic characteristics is so serious that the resulting offset master causes conspicuous background stains.

If the content of the acidic group in Resin (A) is less than 0.5% by weight, the resulting electrophotographic photoreceptor has too low an initial potential for a sufficient image density to be obtained. If it is more than 15% by weight, dispersibility is reduced only to provide an electrophotographic photoreceptor undergoing deterioration in film surface smoothness and humidity resistance. When used as an offset master, such a photoreceptor causes considerable background stains.

Any of conventionally known resins can be used as Resin (A) as long as the above-stated requirements of physical properties are satisfied. Examples of such known resins include polyester resins, modified epoxy resins, silicone resins, olefin resins, polycarbonate resins, vinyl alkanoate resins, allyl alkanoate resins, modified polyamide resins, phenol resins, fatty acid-modified alkyd resins, and acrylic resins.

Preferred of Resin (A) is a (meth)acrylic copolymer containing at least 30% by weight of at least one copolymerization component corresponding to a monomer represented by formula (a-3):

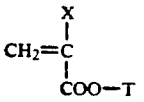

(a-3)

wherein X represents a hydrogen atom, a halogen atom (e.g., chlorine and bromine), a cyano group, or an alkyl group having from 1 to 4 carbon atoms; and T represents a substituted or unsubstituted alkyl group having from 1 to 18 carbon atoms (e.g., methyl, ethyl, propyl, butyl, pentyl, hexyl, octyl, decyl, dodecyl, tridecyl, tetradecyl, 2-methoxyethyl, and 2-ethoxyethyl), a substituted or unsubstituted alkenyl group having from 2 to 18 carbon atoms (e.g., vinyl, allyl, isopropenyl, butenyl, hexenyl, heptenyl, and octenyl), a substituted or unsubstituted aralkyl group having from 7 to 12 carton atoms (e.g., benzyl, phenethyl, methoxybenzyl, ethoxybenzyl, and methylbenzyl), a substituted or unsubstituted cycloalkyl group having from 5 to 8 carbon atoms ,e.g., cyclopentyl, cyclohexyl, and cycloheptyl), or a substituted or unsubstituted aryl group (e.g., phenyl, tolyl, xylyl, mesityl, naphthyl, methoxyphenyl, ethoxyphenyl, chlorophenyl, and dichlorophenyl).

More preferred of Resin (A) is a methacrylate polymer containing at least 30% by weight of at least one repeating unit represented by the above-described formula (a-1) or (a-2).

In formula (a-1), $X_1$ and $X_2$ each preferably represents a hydrogen atom, a chlorine atom, a bromine atom, an alkyl group having from 1 to 4 carbon atoms (e.g., methyl, ethyl, propyl, and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl), an aryl group (e.g., phenyl, tolyl, xylyl, bromophenyl, methoxyphenyl, chloropheryl, and dichlorophenyl), or $—COY_1$ or $—COOY_2$, wherein $Y_1$ and $Y_2$ each preferably represents any of the above-recited hydrocarbon groups, provided that $X_1$ and $X_2$ do not simultaneously represent a hydrogen atom.

In formula (a-1), $W_1$ is a linking group containing 1 to 4 linking atoms, e.g., $-(CH_2)_n-$ (n: 1, 2 or 3), $—CH_2CH_2OCO—$, $-(CH_2O)_m-$ (m: 1 or 2), and $—CH_2CH_2O—$, which connects —COO— and the benzene ring.

In formula (a-2), $W_2$ has the same meaning as $W_1$ of formula (a-1).

Specific examples of repeating units represented by formula (a-1) or (a-2) are shown below for illustrative purposes only but not for limitation.

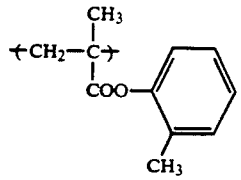

(i-1)

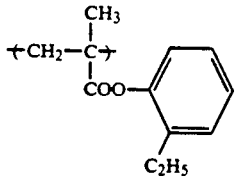

(i-2)

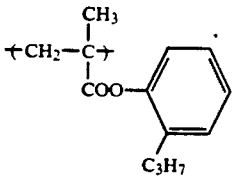

(i-3)

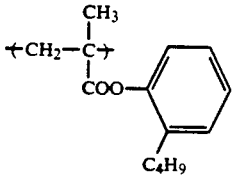

(i-4)

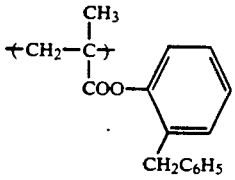

(i-5)

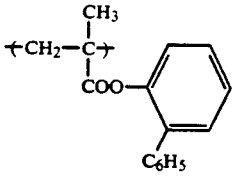

(i-6)

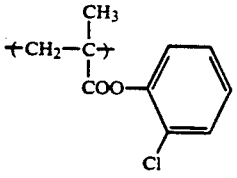

(i-7)

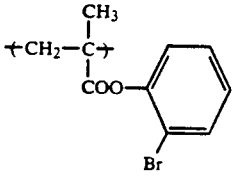

(i-8)

-continued
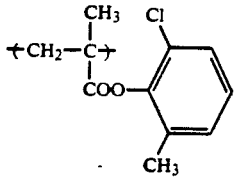
(i-9)
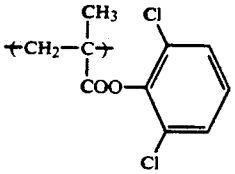
(i-10)
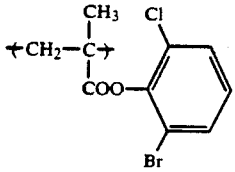
(i-11)
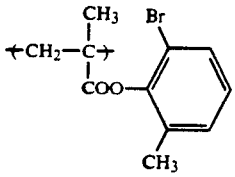
(i-12)
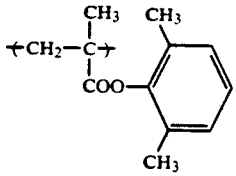
(i-13)
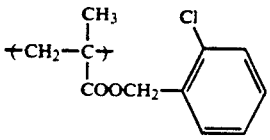
(i-14)
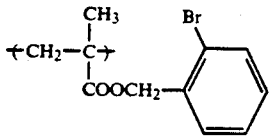
(i-15)
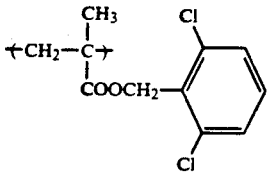
(i-16)
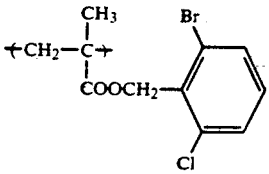
(i-17)
-continued
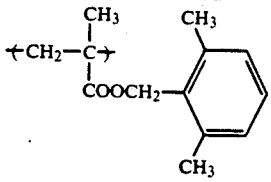
(i-18)
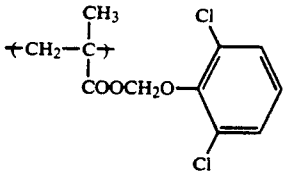
(i-19)
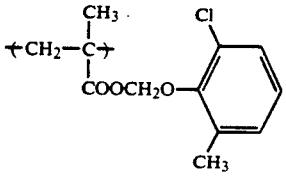
(i-20)
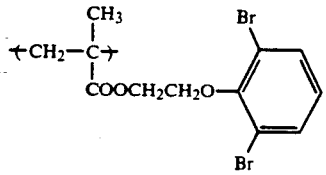
(i-21)
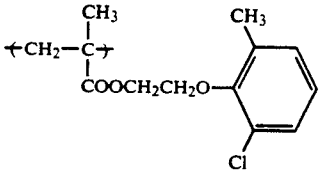
(i-22)
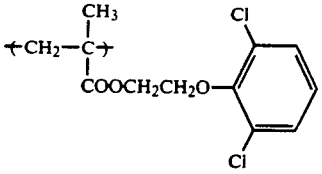
(i-23)
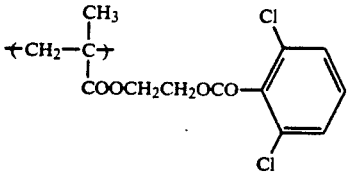
(i-24)
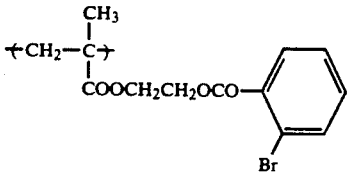
(i-25)
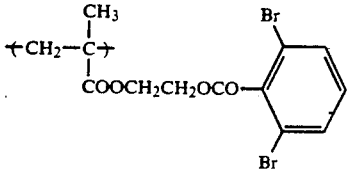
(i-26)

-continued (i-27)

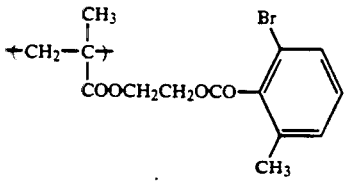

(i-28)

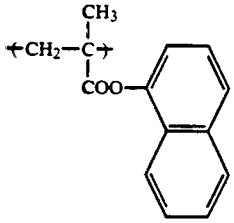

(i-29)

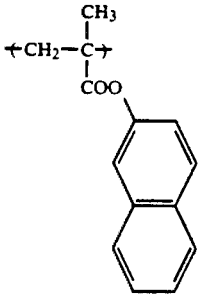

(i-30)

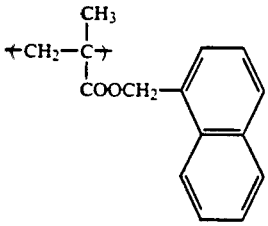

(i-31)

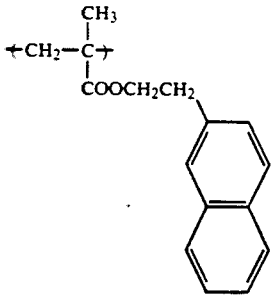

(i-32)

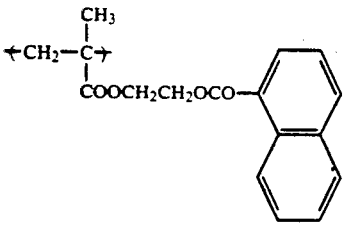

(i-33)

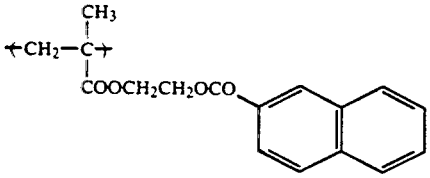

-continued (i-34)

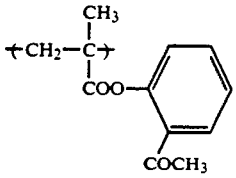

(i-35)

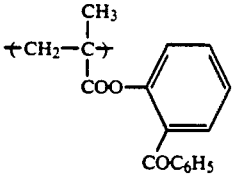

(i-36)

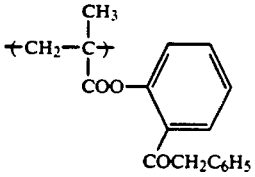

(i-37)

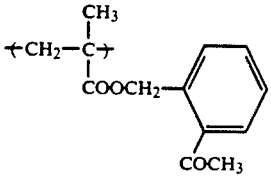

(i-38)

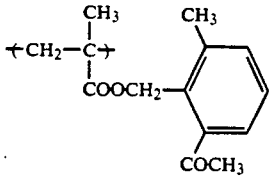

(i-39)

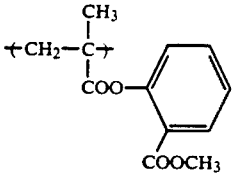

Resin (A) may further comprise other copolymerizable monomers in addition to the monomer of formula (a-3). Examples of such monomers include α-olefins, vinyl alkanoates, allyl alkanoates, acrylonitrile, methacrylonitrile, vinyl ethers, acrylamides, methacrylamides, styrenes, and heterocyclic vinyl compounds (e.g., vinylpyrrolidone, vinylpyridine, vinylimidazole, vinylthiophene, vinylimidazoline, vinylpyrazole, vinyldioxane, vinylquinoline, vinylthiazole, and viryloxazine). From the standpoint of film strength, vinyl acetate, allyl acetate, acrylonitrile, methacrylonitrile, and styrenes are particularly preferred.

The acidic group bonded to one of terminals of the polymer main chain in Resin (A) is preferably selected from $-PO_3H_2$, $-SO_3H$, $-COOH$,

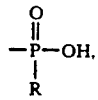

and a cyclic acid anhydride-containing group.

In the acidic group

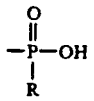

in Resin (A), R represents a hydrocarbon group or —OR', wherein R' represents a hydrocarbon group. The hydrocarbon group as represented by R or R' preferably includes a substituted or unsubstituted aliphatic group having from 1 to 22 carbon atoms (e.g., methyl, ethyl, propyl, butyl, hexyl, octyl, decyl, dodecyl, octadecyl, 2-chloroethyl, 2-methoxyethyl, 2-ethoxypropyl, allyl, tenzyl, phenethyl, 3-phenylpropyl, methylbenzyl, chlorobenzyl, fluorobenzyl, and methoxybenzyl) and a substituted or unsubstituted aryl group (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

The cyclic acid anhydride-containing group is a group containing at least one cyclic acid anhydride moiety. The cyclic acid anhydride which is present includes aliphatic dicarboxylic acid anhydrides and aromatic dicarboxylic acid anhydrides.

Specific examples of aliphatic dicarboxylic acid anhydrides include a succinic anhydride ring, a glutaconic anhydride ring, a maleic anhydride ring, a cyclopentane-1,2-dicarboxylic acid anhydride ring, a cyclohexane-1,2-dicarboxylic acid anhydride ring, a cyclohexene-1,2-dicarboxylic acid anhydride ring, and a 2,3-bicyclo[2,2,2]octanedicarboxylic acid anhydride ring. These rings may be substituted with, for example, a halogen atom (e.g., chlorine and bromine) and an alkyl group (e.g., methyl, ethyl, butyl, and hexyl).

Specific examples of aromatic dicarboxylic acid anhydrides are a phthalic anhydride ring, a naphthalenedicarboxylic acid anhydride ring, a pyridinedicarboxylic acid anhydride ring, and a thiophenedicarboxylic acid anhydride ring. These rings may be substituted with, for example, a halogen atom (e.g., chlorine and bromine), an alkyl group (e.g., methyl, ethyl, propyl and butyl), a hydroxyl group, a cyano group, a nitro group, and an alkoxycarbonyl group (e.g., methoxycarbonyl and ethoxycarbonyl).

Resin (A) can be synthesized in such a manner that the above-described specific acidic group may be bonded to one terminal of the main chain of a polymer comprising the polymerization component represented by formula (a-1) or (a-2). In greater detail, Resin (A) can be synthesized by a method using a polymerization initiator containing the specific acidic group or a functional group capable of being converted to the acidic group, a method using a chain transfer agent containing the acidic group or a functional group capable of being converted to the acidic group, a method using both of the polymerization initiator and chain transfer agent, and a method using the specific acidic group by taking advantage of termination reaction in anionic polymerization. Reference can be made to, for example, P. Dreyfuss and R. P. Quirk, *Encycl. Polym. Sci. Eng.*, Vol. 7, p. 551 (1987), V. Percec, *Appl. Polym. Sci., Vol.* 285, p. 95 (1985), P. F. Rempp and E. Franta, *Adv. Polym. Sci.*, Vol. 58, p. 1 (1984), Y. Yamashita, *J. Appl. Polym. Sci., Appl. Polym. Symp.*, Vol. 36, p. 193 (1981), and R. Asami and M. Takaki, *Macromol. Chem. Suppl.*, Vol. 12, p. 163 (1985).

Resin (B) which can be used in the present invention is a comb type copolymer resin having the above-described physical properties and comprising at least monofunctional Macromonomer (M) and monomer (b-4).

Resin (B) preferably has a weight average molecular weight of not less than $2\times10^4$, more preferably of from $5\times10^4$ to $3\times10^5$. Resin (B) preferably has a glass transition point ranging from 0° C. to 120° C., more preferably from 10° C. to 90° C.

Monofunctional Macromonomer (M) is a polymer having a weight average molecular weight of rot more than $2\times10^4$, which comprises at least one polymerization component represented by formula (b-2) or (b-3), with a polymerizable double bond-containing group represented by formula (b-1) being bonded to only one of the terminals of the main chain thereof.

In formulae (b-1), (b-2) and (b-3), the hydrocarbon groups as represented by $a_1$, $a_2$, V, $b_1$, $b_2$, $X_0$, $Q_0$, and Q, which contain the respectively recited number of carbon atoms when unsubstituted, may have a substituent.

In formula (b-1), V represents —COO—, —OCO—, —$CH_2$OCO—, —$CH_2$COO—, —O—, —$SO_2$—, —CO—,

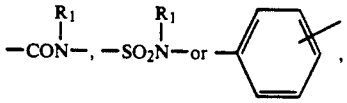

wherein $R_1$ represents a hydrogen atom or a hydrocarbon group. Preferred hydrocarbon groups as $R_1$ include a substituted or unsubstituted alkyl group having from 1 to 18 carbon atoms (e.g., methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), a substituted or unsubstituted alkenyl group having from 4 to 18 carbon atoms (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), a substituted or unsubstituted aralkyl group having from 7 to 12 carbon atoms (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), a substituted or unsubstituted alicyclic group having from 5 to 8 carbon atoms (e.g., cyclohexyl, 2-cyclohexylethyl, and 2-cyclopentylethyl), and a substituted or unsubstituted aromatic group having from 6 to 12 carbon atoms (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, and dodecyloylamidophenyl).

When V represents

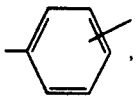

the benzene ring may have a substituent, such as a halogen atom (e.g., chlorine and bromine), an alkyl group (e.g., methyl, ethyl, propyl, butyl, chloromethyl, and methoxymethyl), and an alkoxyl group (e.g., methoxy, ethoxy, propoxy, and butoxy).

$a_1$ and $a_2$, which may be the same or different, each preferably represents a hydrogen atom, a halogen atom (e.g., chlorine and fluorine), a cyano group, an alkyl group having from 1 to 4 carbon atoms (e.g., methyl, ethyl, propyl and butyl), or —COO—Z or —COO—Z bonded via a hydrocarbon group, wherein Z represents a hydrogen atom or an alkyl, alkenyl, aralkyl, alicyclic or aryl group having up to 18 carbon atoms, each of which may be substituted. More specifically, the examples of the hydrocarbon groups as enumerated for $R_1$ are applicable to Z. The hydrocarbon group via which —COO—Z is bonded include a methylene group, an ethylene group, and a propylene group.

More preferably V represents —COO—, —OCO—, —$CH_2$OCO—, —$CH_2$COO—, —O—, —CONH—, —$SO_2$NH— or

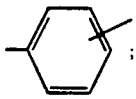

and $a_1$ and $a_2$, which may be the same or different, each represents a hydrogen atom, a methyl group, —COOZ, or —$CH_2$COOZ, wherein Z represents a hydrogen atom or an alkyl group having from 1 to 6 carbon atoms (e.g., methyl, ethyl, propyl, butyl, and hexyl). Most preferably, at least one of $a_1$ and $a_2$ represents a hydrogen atom.

Specific examples of polymerizable double bond-containing groups represented by formula (b-1) are

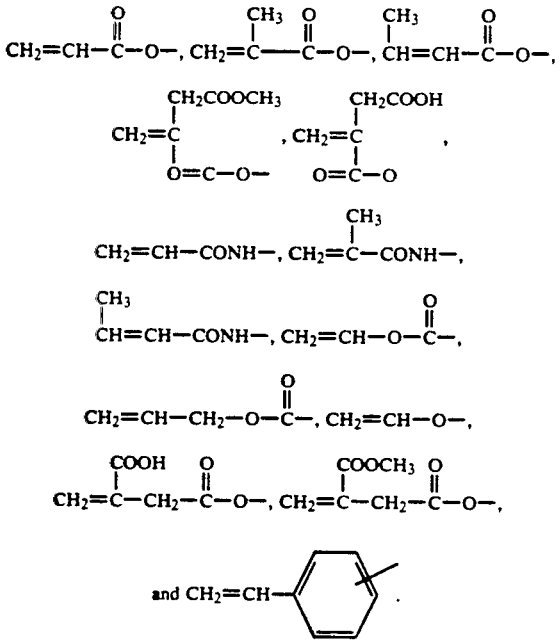

In formula (b-2), $X_0$ has the same meaning as V in formula (b-1); $b_1$ and $b_2$, which may be the same or different, each has the same meaning as $a_1$ and $a_2$ in formula (b-1); and $Q_0$ represents an aliphatic group having from 1 to 18 carbon atoms or an aromatic group having from 6 to 12 carbon atoms. Examples of the aliphatic group for $Q_0$ include a substituted or unsubstituted alkyl group having from 1 to 18 carbon atoms (e.g., methyl, ethyl, propyl, butyl, heptyl, hexyl, octyl, decyl, dodecyl, tridecyl, hexadecyl, octadecyl, 2-chloroethyl, 2-bromoethyl, 2-hydroxyethyl, 2-methoxyethyl, 2-ethoxyethyl, 2-cyanoethyl, 3-chloropropyl, 2-(trimethoxysilyl)ethyl, 2-tetrahydrofuryl, 2-thienylethyl, 2-N,N-dimethylaminoethyl, and 2-N,N-diethylaminoethyl), a cycloalkyl group having from 5 to 8 carbon atoms (e.g., cycloheptyl, cyclohexyl, and cyclooctyl), and a substituted or unsubstituted aralkyl group having from 7 to 12 carbon atoms (e.g., benzyl, phenethyl, 3-phenylpropyl, naphthylmethyl, 2-naphthylethyl, chlorobenzyl, bromobenzyl, dichlorobenzyl, methylbenzyl, chloromethylbenzyl, dimethylbenzyl, trimethylbenzyl, and methoxybenzyl). Examples of the aromatic group for $Q_0$ include a substituted or unsubstituted aryl group having from 6 to 12 carbon atoms (e.g., phenyl, tolyl, xylyl, chlorophenyl, bromophenyl, dichlorophenyl, chloromethylphenyl, methoxyphenyl, methoxycarbonylphenyl, naphthyl, and chloronaphthyl).

In formula (b-2), $X_0$ preferably represents —COO—, —OCO—, —$CH_2$COO—, —$CH_2$OCO—, —O—, —CO—, —CONH—, —$SO_2$NH—, or

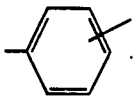

Preferred examples of $b_1$ and $b_2$ are the same as those described as preferred examples of $a_1$ and $a_2$.

In formula (b-3), Q represents —CN, —$CONH_2$, or

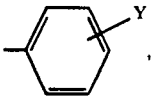

wherein Y represents a hydrogen atom, a halogen atom (e.g., chlorine and bromine), an alkoxyl group (e.g., methoxy and ethoxy), or —COOR', wherein R' preferably represents an alkyl group having from 1 to 8 carbon atoms, an aralkyl group having from 7 to 12 carbon atoms, or an aryl group.

Macromonomer (M) may contain two or more polymerization components represented by formula (b-2) or (b-3). In cases where $Q_0$ in formula (b-2) is an aliphatic group having from 6 to 12 carbon atoms, it is preferable that the proportion of such a polymerization component of (b-2) should not exceed 10% by weight based on the total polymerization component in Macromonomer (M). In cases where $X_0$ in formula (b.2) is —COO—, it is preferable that the proportion of such a polymerization component of (b-2) be present in a proportion of at least 30% by weight based on the total polymerization component in Macromonomer (M).

In addition to polymerization components of formula (b-2) and/or (b-3), Macromonomer (M) may further contain other repeating units derived from copolymerizable monomers. Such monomers include acrylonitrile, methacrylonitrile, acrylamides, methacrylamides, styrene and its derivatives (e.g., vinyltoluene, chlorostyrene, dichlorostyrene, bromostyrene, hydroxynethylstyrene, and N,N-dimethylaminomethylstyrene), and haterocyclic vinyl compounds (e.g., vinylpyridine, vinylimidazole, vinylpyrrolidone, vinylthiophene, vinylpyrazole, vinyldioxane, and vinyloxazine).

As illustrated above, Macromonomer (M) which can be used in the present invention has a structure in which the polymerizable double bond-containing group represented by formula (b-1) is bonded to one of the terminals of a polymer main chain comprising repeating units of formula (b-2) and/or repeatinq units of formula (b-3) either directly or via an arbitrary linking group.

The linking group which may be present between component of formula (b-1) and components of (b-2) or (b-3) includes a carbon-carbon double bond (either single bond or double bond), a carbon-hetero atom bond (the hetero atom includes an oxygen atom,-a sulfur atom, a nitrogen atom, and a silicon atom), a hetero atom-hetero atom bond, and a combination thereof.

Preferred of the above-described Macromonomer (M) are those represented by formula (Va) or (Vb):

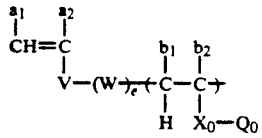

(Va)

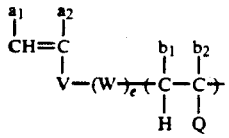

(Vb)

wherein $a_1$, $a_2$, $b_1$, $b_2$, V, $X_0$, $Q_0$ and Q are as defined above; W represents a linking group selected from

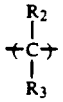

(wherein $R^2$ and $R^3$ each represents a hydrogen atom, a halogen atom (e.g., fluorine, chlorine and bromine), a cyano group, a hydroxyl group, an alkyl group (e.g., methyl, ethyl and propyl), etc.)

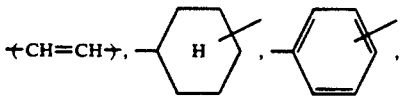

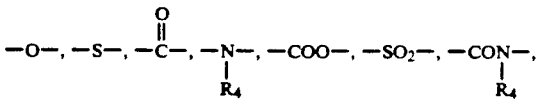

-continued

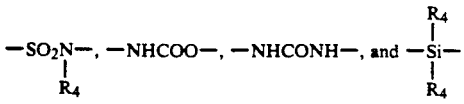

(wherein $R_4$ represents a hydrogen atom or a hydrocarbon group having the same meaning as described for $Q_0$ of formula (b-2)), and combinations thereof, and e represents 0 or 1.

If the weight average molecular weight of Macromonomer (M) exceeds $2\times10^4$, copolymerizability with the monomer of formula (b-4) is reduced. If it is too small, the effect of improving electrophotographic characteristics of the photosensitive layer would be small. Accordingly, Macromonomer (M) preferably has a weight average molecular weight of at least $1\times10^3$.

Macromonomer (M) can be prepared by known methods, such as an ion polymerization process in which one of various kinds of reagents is reacted on the terminal of a living polymer obtained by anion polymerization or cation polymerization to obtain a macromer; a radical polymerization process in which one of various kinds of reagents is reacted with an oligomer terminated with a reactive group which is obtained by radical polymerization in the presence of a polymerization initiator and/or a chain transfer agent containing a reactive group (e.g., a carboxyl group, a hydroxyl group, and an amino group) in the molecule thereof thereby to obtain a macromer; or a polyaddition or polycondensation process in which a polymerizable double bond-containing group is introduced into an oligomer obtained by polyaddition or polycondensation in the same manner as in the above-described radical polymerization process.

For the details, reference can be made to, e.g., P. Dreyfuss and R. P. Quirk, *Encycl. Polym. Sci. Eng.*, Vol. 7, p. 551 (1987), P. F. Rempp and E. Franta, *Adv. Polym. Sci.*, Vol. 58, p. 1 (1984), V. Percec, *Appl. Polym. Sci.*, Vol. 285, p. 95 (1984), R. Asami and M. Takaki, *Macromol. Chem. Suppl.*, Vol. 12, p. 163 (1985), P. Rempp, et al., *Macromol. Chem. Suppl.*, Vol. 8, p. 3 (1984), Yushi Kawakami, *Kagaku Kogyo*, Vol. 38, p. 56 (1987), Yuya Yamashita, *Kobunshi*, Vol. 31, p. 988 (1982), Shiro Kobayashi, *Kobunshi*, Vol. 30, 625 (1981), Toshinobu Higashimura, *Nippon Secchaku Kyokaishi*, Vol. 18, p. 536 (1982), Koichi Itoh, *Kobunshi Kako*, Vol. 35, p. 262 (1986), Shiro Toki and Takashi Tsuda, *Kino Zairyo*, Vol. 1987, No. 10, p. 5, and references cited in the above literature.

Specific examples of Macromonomer (M) which can be used in the present invention are shown below for illustrative purposes only but not for limitation.

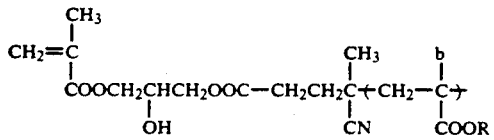

b: H, $CH_3$, or $-CH_2COOCH_3$

R: $-C_nH_{2n+1}$ (n: integer of 1 to 8), $-CH_2C_6H_5$,

-continued
(1)
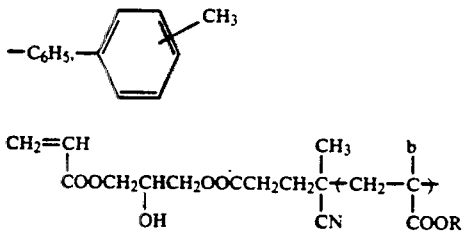
b: H, $CH_3$, or $-CH_2COOCH_3$
R: $-C_nH_{2n+1}$ (n: integer of 1 to 18), $-CH_2C_6H_5$,
(2)
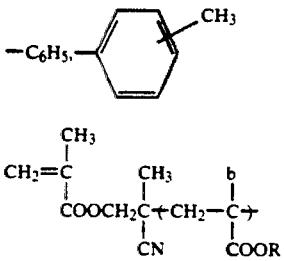
b: H, $CH_3$
R: $-C_nH_{2n+1}$ (n: integer of 1 to 18),
$\leftarrow CH_2 \rightarrow_m C_6H_5$ (m: integer of 1 to 3),
(3)
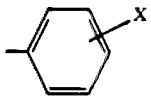
(X: $CH_3$, Cl, Br, $OCH_3$)
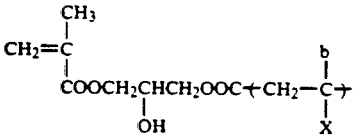
b: H, $CH_3$
X: $-COOCH_3$, $-C_6H_5$, $-CN$
(4)
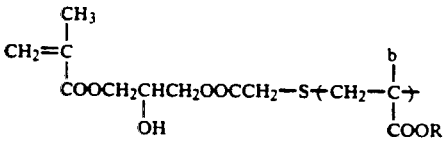
b: H or $CH_3$
R: $-C_nH_{2n+1}$ (n: integer of 1 to 18), $-CH_2C_6H_5$,
(5)
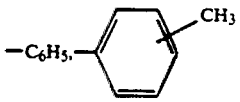
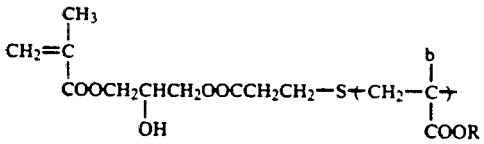
b: H, $CH_3$ or $-CH_2COOCH_3$
R: $-C_nH_{2n+1}$ (n: integer of 1 to 18), $-CH_2C_6H_5$, -continued
(6)
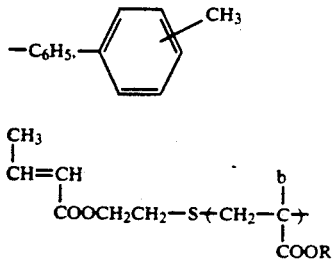
b and R: same as defined in (6) above
(7)
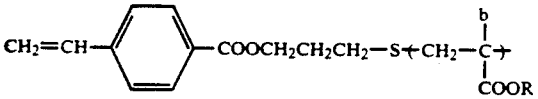
b: H, $-CH_3$
R: $-C_nH_{2n+1}$ (n: integer of 1 to 18), $-CH_2C_6H_5$,
(8)
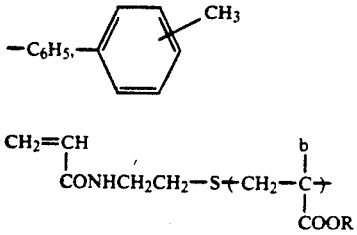
b: H, $-CH_3$
R: $-C_nH_{2n+1}$ (n: integer of 1 to 18), $-CH_2C_6H_5$,
$-C_6H_5$
(9)
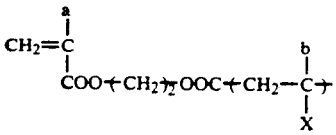
a: H, $CH_3$
b: H, $CH_3$
X: $-OC_nH_{2n+1}$ (n: integer of 1 to 18),
$-OCOC_mH_{2m+1}$ (m: integer of 1 to 18),
$-COOCH_3$, $-C_6H_5$, $-CN$
(10)
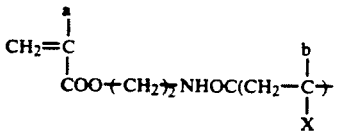
a: H, $CH_3$
b: H, $CH_3$
(11)
X: $-COOCH_3$, $-C_6H_5$, 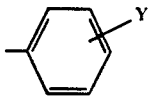 (Y: $-CH_3$, $-Cl$, $-Br$)

-continued
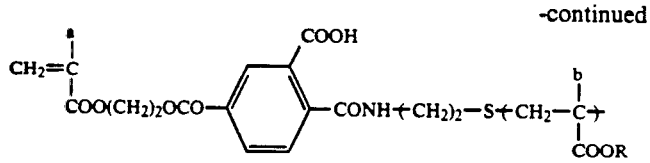
a: H, $CH_3$
b: H, $CH_3$
R: $-C_nH_{2n+1}$ (n: integer of 1 to 18), $-CH_2C_6H_5$, $-C_6H_5$
(12)
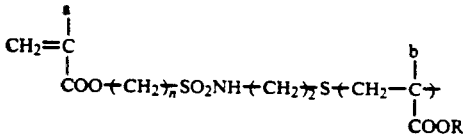
a: H, $CH_3$
b: H, $CH_3$
n: integer of 2 to 4
R: $-C_mH_{2m+1}$ (m: integer of 1 to 18), $-CH_2C_6H_5$, $-C_6H_5$
(13)
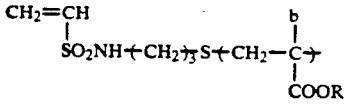
b: H, $CH_3$
R: $-C_nH_{2n+1}$ (n: integer of 1 to 18), $-CH_2C_6H_5$, $-C_6H_5$
(14)
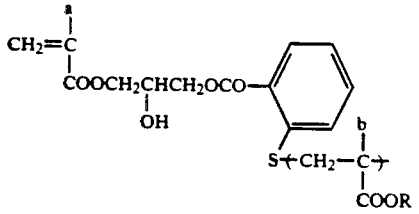
a: H, $CH_3$
b: H, $CH_3$
R: $-C_nH_{2n+1}$ (n: integer of 1 to 18), $-CH_2C_6H_5$, $-C_6H_5$
(15)
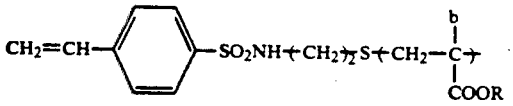
b: H, $CH_3$
R: $-C_nH_{2n+1}$ (n: integer of 1 to 18), $-CH_2C_6H_5$, $-C_6H_5$
(16)
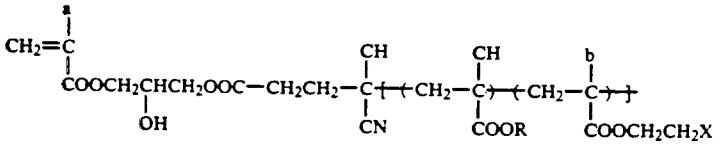

-continued
a: H, $CH_3$
b: H, $CH_3$
R: $-C_nH_{2n+1}$ (n: integer of 1 to 18), $-CH_2C_6H_5$, $-C_6H_5$
X: —Cl, —Br, —F, —OH, —CN (17)
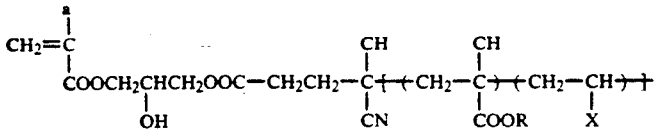
a: H, $CH_3$
X: $-OCOC_nH_{2n+1}$ (n: integer of 1 to 18), —CN, $-CONH_2$, $-C_6H_5$
R: $-C_nH_{2n+1}$ (n: integer of 1 to 18), $-CH_2C_6H_5$ (18)
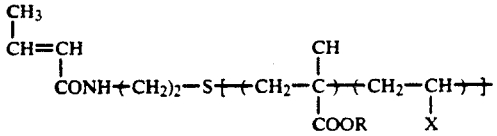
X: —CN, $-CONH_2$, $-C_6H_5$
R: $-C_nH_{2n+1}$ (n: integer of 1 to 18), $-CH_2C_6H_5$
(19)
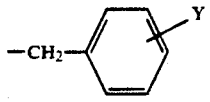
(Y: Cl, Br, $CH_3$, $-OCH_3$)
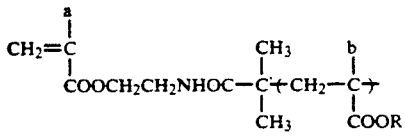
a: H, $CH_3$
b: H, $CH_3$, $-CH_2COOCH_3$
R: $-C_nH_{2n+1}$ (n: integer of 1 to 18), $-CH_2C_6H_5$ (20)
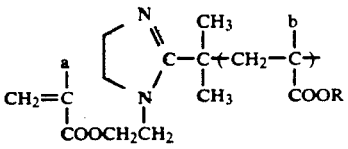
a: H, $CH_3$
b: H, $CH_3$, $-CH_2COOCH_3$
R: $-C_nH_{2n+1}$ (n: integer of 1 to 18), $-CH_2C_6H_5$ (21)
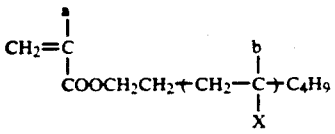
a: H, $CH_3$
b: H, $CH_3$
X: $-COOCH_3$, $-C_6H_5$ -continued (22)

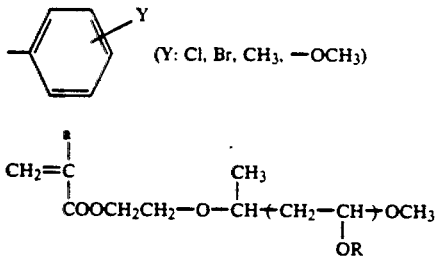

(Y: Cl, Br, $CH_3$, $-OCH_3$)

■: H, $CH_3$

R: $-C_nH_{2n+1}$ (n: integer of 1 to 18)

(23)

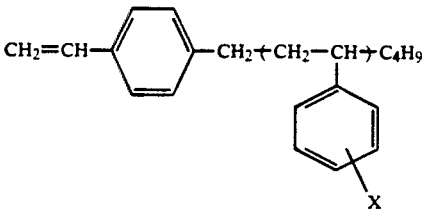

X: H, $CH_3$, Cl, Br, $OCH_3$, $-COOCH_3$ (24)

In formula (b-4) representing a monomer to be copolymerized with Macromonomer (M), $c_1$ and $c_2$, which may be the same or different, each has the same meaning as $a_1$ and $a_2$ in formula (b-1); $X_1$ has the same meaning as $X_0$ in formula (b-2); and $Q_1$ has the same meaning as $Q_0$ in formula (b-2).

In addition to Macromonomer (M) and monomer represented by formula (b-4), Resin (B) may further contain other copolymerizable monomers as copolymerization components. Included in copolymerizable monomers are the vinyl compounds as enumerated with respect to Resin (A) and, in addition, α-olefins, acrylonitrile, methacrylonitrile, acrylamide, methacrylamide, styrene, vinyl-containing naphthalene compounds (e.g., vinylnaphthalene and 1-isopropenylnaphthalene), and vinyl-containing heterocyclic compounds (e.g., vinylpyridine, vinylpyrrolidone, vinylthiophene, vinyltetrahydrofuran, vinyl-1,3-dioxolan, vinylimidazole, vinylthiazole, and vinyloxazoline).

In Resin (B), a copolymerization ratio of Macromonomer (M) to monomer of formula (b-4) ranges 1 to 90/99 to 10, preferably 5 to 60/95 to 40, by weight.

Resin (B) may contain a repeating unit derived from an acidic group-containing vinyl compound. In this case, it is preferable that the proportion of such a repeating unit does not exceed 10% by weight of the total copolymer. If it exceeds 10% by weight, the mutual action with inorganic photoconductive particles would become so marked that surface smoothness of the resulting photoreceptor is impaired, which results in deterioration in electrophotographic characteristics, particularly charging properties and dark decay retention.

Of the above-described Resin (B), preferred is Resin (B'), in which at least one acidic group selected from $-PO_3H_2$, $-SO_3H$, $-COOH$ and $-PO_3R''H$ (wherein R'' represents a hydrocarbon group; more specifically R'' has the same meaning as R) is bonded to only one terminal of the main chain of the polymer comprising at least one repeating unit derived from Macromonomar (M) and at least one repeating unit derived from monomer of formula (b-4).

This being the case, it is preferable that the polymer main chain does not contain a copolymerization component containing a polar group such as a carboxyl group, a sulfo group, a hydroxyl group, and a phosphono group.

The above-described acidic group may be bonded to one of the polymer main chain terminals either directly or via an arbitrary linking group.

The linking group for connecting the acidic group to the terminal is selected from a carbon-carbon bond (single bond or double bond), a carbon-hetero atom bond (the hetero atom includes an oxygen atom, a sulfur atom, a nitrogen atom, a silicon atom, etc.), a hetero atom-hetero atom bond, and an arbitrary combination thereof. Examples of linking groups are

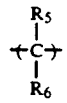

(wherein $R_5$ and $R_6$ each has the same meaning as $R_2$ and $R_3$),

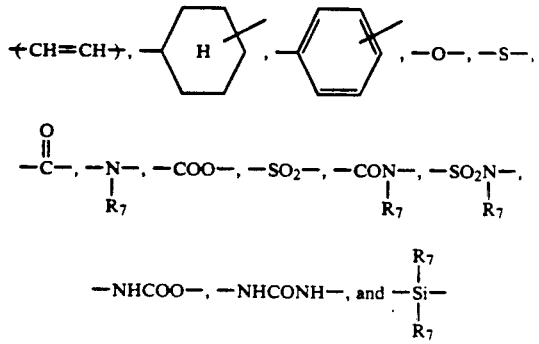

(wherein $R_7$ has the same meaning as $R_4$), and combinations thereof.

In Resin (B'), the content of the acidic group bonded to one terminal of the polymer main chain preferably ranges from 0.1 to 15% by weight, more preferably from 0.5 to 10% by weight, based on resin (B'). If it is less than 0.1% by weight, the effect of improving film strength would be small. If it exceeds 15% by weight, the photoconductive substance cannot be uniformly dispersed in the binder, forming an agglomerate, which results in a failure of forming a uniform coating film.

Resin (B') according to the present invention, in which the specific acidic group is bonded to only one terminal of the polymer main chain, can easily be prepared by an ion polymerization process in which a various kind of a reagent is reacted on the terminal of a living polymer obtained by conventionally known anion polymerization or cation polymerization; a radical polymerization process, in which radical polymerization is performed in the presence of a polymerization initiator and/or a chain transfer agent containing a specific acidic group in the molecule thereof; or a process in which a polymer having a reactive group at the terminal thereof as obtained by the above-described ion polymerization or radical polymerization is subjected to a high molecular weight reaction to convert the terminal to a specific acidic group.

For the details, reference can be made to, e.g., P. Dreyfuss and R. P. Quirk, *Encycl. Polym. Sci. Eng.*, Vol. 7, p. 551 (1987), Yoshiki Nakajo and Yuya Yamashita, *Senryo to Yakuhin*, Vol. 30, p. 232 (1985), Akira Ueda and Susumu Nagai, *Kagaku to Kogyo*, Vol. 60, p. 57 (1986), and references cited therein.

The ratio of Resin (A) to Resin (B), inclusive of resin (B'), varies depending on the kind, particle size, and surface conditions of the inorganic photoconductive material used. In general, the weight ratio of Resin (A) to Resin (B) is 5 to 80:95 to 20, preferably 10 to 60:90 to 40.

The inorganic photoconductive materials which can be used in the present invention include zinc oxide, titanium oxide, zinc sulfide, cadmium sulfide, cadmium carbonate, zinc selenide, cadmium selenide, tellurium selenide and lead sulfide.

The resin binder is used in a total amount of from 10 to 100 parts by weight, preferably from 15 to 50 parts by weight, per 100 parts by weight of the inorganic photoconductive material.

If desired, the photoconductive layer can contain various dyes as a spectral sensitizer. Examples of suitable spectral sensitizers are carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, styryl dyes), and phthalocyanine dyes inclusive of metallized phthalocyanine dyes, as described, e.g., in Harumi Miyamoto and Hidehiko Takei, *Imaging*, Vol. 1973, No. 8, p. 12, C. J. Young, et al., *RCA Review*, Vol. 15, p. 469 (1954), Kohei Kiyota, et al., *Denki Tsushin Gakkai Ronbunshi J 63-C*, No. 2, p. 97 (1980), Yuji Harasaki, et al., *Kogyo Kagaku Zasshi*, Vol. 66, pp. 78 and 188 (1963), and Tadaaki Tani, *Nippon Shashin Gakkaishi*, Vol. 35, p. 08 (1972).

Specific examples of suitable carbonium dyes, triphenylmethane dyes, xanthene dyes and phthalein dyes are described in JP-B-51-452, JP-A-50-90334, JP-A-50-14227, JP-A-53-39130, JP-A-53-82353, U.S. Pat. Nos. 3,052,540 and 4,054,450 and JP-A-57-16456. Suitable polymethine dyes, e.g., oxonol dyes, xerocyanine dyes, cyanine dyes and rhodacyanine dyes are described in F. M. Harmmer, *The Cyanine Dyes and Related Compounds*. Specific examples are described in U.S. Pat. Nos. 3,047,384, 3,110,591, 3,121,008, 3,125,447, 3,128,179, 3,132,942 and 3,622,317, British Patents 1,226,892, 1,309,274 and 1,405,898, and JP-B-48-7814 and JP-B-55-18892. Suitable polymethine dyes capable of spectral sensitization in the near infrared to infrared regions of wavelengths longer than 700 nm are described in JP-A-47-840, JP-A-47-44180, JP-B-51-41061, JP-A-49-5034, JP-A-49-45122, JP-A-57-46245, JP-A-56-35141, JP-A-57-5754, JP-A-61-26044, JP-A-61-27551, U.S. Pat. Nos. 3,619,154 and 4,175,956, and *Research Disclosure*, 216, pp. 117–118 (1982).

The photoconductive layer of the present invention is excellent in that their performance properties tend not to vary depending on the kind of sensitizing dyes used in combination.

If desired, the photoconductive layer may further contain various additives commonly employed in an electrophotographic photosensitive layers such as chemical sensitizers. Examples of such additives include electron accepting compounds (e.g., halogen, benzoquinone, chloranil, acid anhydrides, organic carboxylic acids) as described in *Imaging*, No. 8. p. 12 (1973) supra; and polyarylalkane compounds, hindered phenol compounds, and p-phenylenediamine compounds as described in Hiroshi Komon, et al., *Saikin no Kododen Zairyo to Kankotai no Kaihatsu.Jitsuyoka*, Chs. 4–6, Nippon Kagaku Joho Shuppanbu (1986). The amount of these additives is not particularly critical and usually ranges from 0.0001 to 2.0 parts by weight per 100 parts by weight of the photoconductive substance.

The photoconductive layer can be provided on any known support, usually to a thickness of from 1 to 100 μm, preferably from 10 to 50 μm.

When the present invention is applied to a laminated photoreceptor comprising a charge generating layer and a charge transport layer, the photoconductive layer functioning as the charge generating layer has a thickness of from 0.01 to 1 μm, preferably from 0.05 to 0.5 μm.

If desired, an insulating layer can be provided on the photoconductive layer for the chief purposes of protection of the photoreceptor and for improvement of durability and dark decay characteristics. In this case, the insulating layer is coated to a relatively small thickness. For particular use in a specific electrophotographic processing, the insulating layer is coated to a relatively large thickness. In the latter case, the insulating layer usually has a thickness of from 5 to 70 μm, preferably from 10 to 50 μm.

In the above-described laminated photoreceptor, useful charge transport materials include polyvinylcarbazole, oxazole dyes, pyrazoline dyes, and triphenylmethane dyes. The charge transport layer usually has a thickness of from 5 to 40 μm, preferably from 10 to 30 μm.

Resins which can be used for formation of the insulating layer or charge transport layer typically include thermoplastic resins and curable resins, such as polystyrene resins, polyester resins, cellulose resins, polyether resins, vinyl chloride resins, vinyl acetate resins, vinyl chloride-vinyl acetate copolymer resins, polyacrylic resins, polyolefin resins, urethane resins, epoxy resins, melamine resins, and silicone resins.

The photoconductive layer is formed on a conventional support. In general, a support for an electrophotographic photosensitive layer is preferably electrically conductive. Any of conventionally employed conductive supports may be utilized in this invention. Examples of usable conductive supports include a base material (e.g., a metal sheet, paper, a synthetic resin sheet) having been rendered electrically conductive by, for example, impregnation with a low resistant substance; a base material with the back side thereof (opposite to the photosensitive layer side) being rendered conductive and further coated thereon at least ore layer for preventing curling, etc.; the above-described supports having further thereon a water-resistant adhesive layer; the above-described supports having further thereon at least one precoat layer; and a paper laminated with a synthetic resin film on which aluminum, etc., is deposited.

Specific examples of conductive supports and materials for imparting conductivity are described in Yukio Sakamoto, *Denshishashin*, Vol. 14, No. 1, pp. 2-11 (1975), Hiroyuki Moriga, *Nyumon Tokushushi no Kagaku*, Kobunshi Kankokai (1975), and M. F. Horver, *J. Macromol. Sci. Chem.*, A-4 (6), pp. 1327-1417 (1970).

The present invention will now be illustrated in greater detail by way of Synthesis Examples, Examples, and Comparative Examples, but it should be understood that the present invention is not deemed to be limited thereto. Unless otherwise indicated herein, all parts, percents, ratios and the like are by weight.

SYNTHESIS EXAMPLE A-1

Synthesis of Resin (A)-1

A solution of a mixture of 95 g of benzyl methacrylate and 200 g of toluene was heated to 90° C. in a nitrogen stream, and 5 g of 4,4'-azobis(4-cyanovaleric acid) (hereinafter abbreviated as "ACV") was added thereto, followed by allowing the mixture to react for 10 hours. The resulting copolymer was designated Resin (A)-1. Resin (A)-1 had a weight average molecular weight (hereinafter referred to as "Mw") of 8,300.

SYNTHESIS EXAMPLE A-2

Synthesis of Resin (A)-2

A solution of a mixture of 95 g of ethyl methacrylate, 5 g of thioglycolic acid, and 200 g of toluene was heated to 75° C. in a nitrogen stream, and 1.0 g of azobisisobutyronitrile (hereinafter abbreviated as AIBN) was added thereto, and the reaction was conducted for 8 hours. The resulting Resin (A)-2 had an Mw of 7,800.

SYNTHESIS EXAMPLES A-3 TO A-15

Synthesis of Resins (A)-3 to (A)-15

Resins (A)-3 to (A)-15 shown in Table 1 below were synthesized in the same manner as in Synthesis Example A-2, except for replacing thioglycolic acid as used as a chain transfer agent in Synthesis Example A-2 with each of the compounds shown in Table 1 below.

TABLE 1

| Synthesis Example A No. | Resin (A) | Chain Transfer Agent | Mw of Resin (A) |
|---|---|---|---|
| 3 | (A)-3 | $HS(CH_2)_2-COOH$ | 8,300 |
| 4 | (A)-4 | $HS-CH(CH_2-COOH)-COOH$ | 7,600 |
| 5 | (A)-5 | 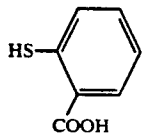 | 7,700 |
| 6 | (A)-6 | $HSCH_2CH_2SO_3H$ | 7,600 |
| 7 | (A)-7 | $HS(CH_2)_3O-P(=O)(OH)-OH$ | 7,800 |
| 8 | (A)-8 | $HS(CH_2)_2O-P(=O)(OC_2H_5)-OH$ | 8,000 |
| 9 | (A)-9 | 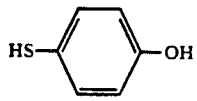 | 7,500 |
| 10 | (A)-10 | 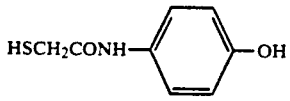 | 7,800 |

TABLE 1-continued

| Synthesis Example A No. | Resin (A) | Chain Transfer Agent | Mw of Resin (A) |
|---|---|---|---|
| 11 | (A)-11 | 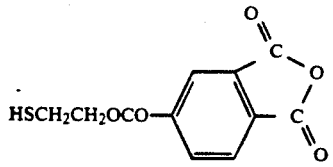 | 8,800 |
| 12 | (A)-12 | $HSCH_2CH_2NHCOCH_2CH_2COOH$ | 9,500 |
| 13 | (A)-13 | $HSCH_2CH_2OCOCH{=}CHCOOH$ | 9,300 |
| 14 | (A)-14 | 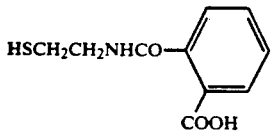 | 8,900 |
| 15 | (A)-15 | 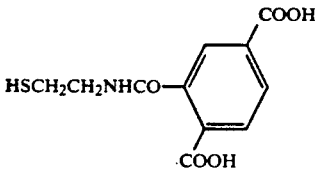 | 10,000 |

SYNTHESIS EXAMPLES A-16

Synthesis of Resin (A)-16

A solution of a mixture of 95 g of n-propyl methacrylate and 200 g of tetrahydrofuran was heated to 70° C. in a nitrogen stream. To the solution was added 6 g of 4,4'-azobis(4-cyanovaleryl chloride), and the reaction was conducted for 10 hours. After cooling to 10° C. or lower, 3 g of pyridine was added to the mixture while stirring, and then a solution of a mixture of 4 g of glycolic acid and 10 ml of acetone was added dropwise thereto taking care not to raise the temperature above 10° C. The reaction was continued at that temperature for 1 hour and then at 20° C. for 4 hours.

The reaction mixture was poured into 2 liters of methanol for reprecipitation, and the solution was removed by decantation to recover a viscous substance, which was then dried. The resulting Resin (A)-16 had an Mw of 10,800.

SYNTHESIS EXAMPLES A-17 TO A-27

Synthesis of Resins (A)-17 to (A)-27

Resins (A)-17 to (A)-27 were synthesized in the same manner as in Synthesis Example A-2, except for replacing ethyl methacrylate and thioglycolic acid as used in Synthesis Example A-2 with each of the monomers and mercapto compounds shown in Table 2 below, respectively.

TABLE 2

| Synthesis Example A No. | Resin (A) | Monomer | Mercapto Compound | | Mw of Resin (A) |
|---|---|---|---|---|---|
| 17 | (A)-17 | Butyl methacrylate (95 g) | $HSCH_2COOH$ | (5 g) | 5,600 |
| 18 | (A)-18 | Benzyl methacrylate (95 g) | 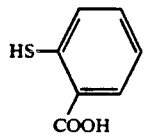 | (5g) | 7,600 |
| 19 | (A)-19 | Phenyl methacrylate (95 g) | " | | 7,700 |
| 20 | (A)-20 | Phenethyl methacrylate (97 g) | $HS{-}CH(CH_2COOH){-}COOH$ | (3 g) | 8,800 |
| 21 | (A)-21 | Methyl methacrylate (30 g)<br>Butyl methacrylate (65 g) | $HSCH_2COOH$ | (5 g) | 6,300 |
| 22 | (A)-22 | Butyl methacrylate (90 g)<br>2-Hydroxyethyl methacrylate (5 g) | " | | 6,000 |
| 23 | (A)-23 | Butyl methacrylate (82 g)<br>Styrene (15 g) | 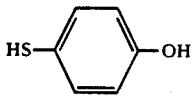 | (3 g) | 4,800 |

TABLE 2-continued

| Synthesis Example A No. | Resin (A) | Monomer | Mercapto Compound | Mw of Resin (A) |
|---|---|---|---|---|
| 24 | (A)-24 | Methyl methacrylate (76 g)<br>Methyl acrylate (20 g) | 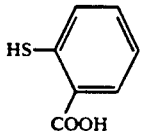 (4 g) | 5,300 |
| 25 | (A)-25 | Propyl methacrylate (95 g) | 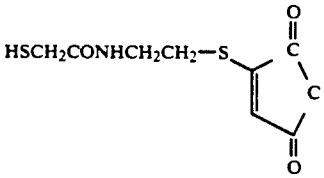 (5 g) | 8,000 |
| 26 | (A)-26 | Ethyl methacrylate (84 g)<br>2-Chloroethyl methacrylate (10 g) | 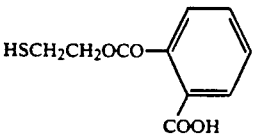 (6 g) | 8,000 |
| 27 | (A)-27 | Propyl methacrylate (83 g)<br>Acrylonitrile (15 g) | 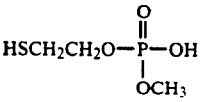 (2 g) | 9,300 |

SYNTHESIS EXAMPLE A-28

Synthesis of Resin (A)-28

A solution of a mixture of 95 g of 2-chloro-6-methylphenyl methacrylate, 150 g of toluene, and 50 g of isopropanol was heated to 80° C. in a nitrogen stream, and 5 g of ACV was added thereto to effect reaction for 10 hours.

The resulting Resin (A)-28 had an Mw of 6,500 and a glass transition temperature of 40° C.

Structure of Resin (A)-28:

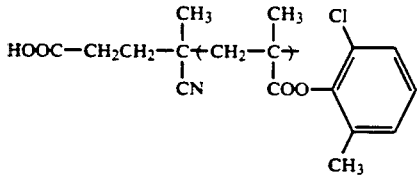

SYNTHESIS EXAMPLES A-29 TO A-50

Synthesis of Resins (A)-29 to (A)-50

Resins (A)-29 to (A)-50 shown in Table 3 below were prepared under the same conditions as in Synthesis Example A-1.

The resulting Resins (A)-29 to (A)-50 had an Mw between 6,000 and 8,000.

TABLE 3

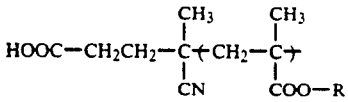

| Synthesis Example A No. | Resin (A) | Ester Substituent R |
|---|---|---|
| 29 | (A)-29 | 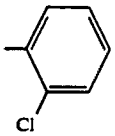 |
| 30 | (A)-30 | 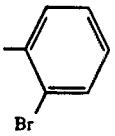 |
| 31 | (A)-31 | 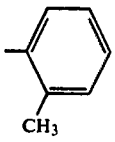 |
| 32 | (A)-32 | 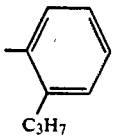 |

TABLE 3-continued
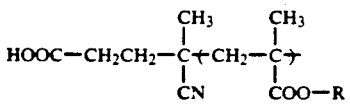
| Synthesis Example A No. | Resin (A) | Ester Substituent R |
|---|---|---|
| 33 | (A)-33 | 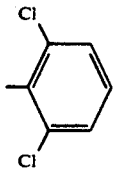 |
| 34 | (A)-34 | 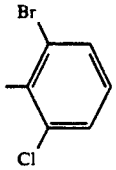 |
| 35 | (A)-35 | 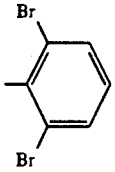 |
| 36 | (A)-36 | 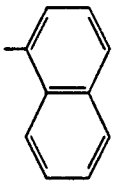 |
| 37 | (A)-37 | 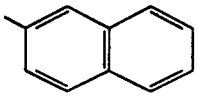 |
| 38 | (A)-38 | 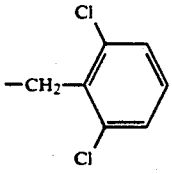 |
| 39 | (A)-39 | 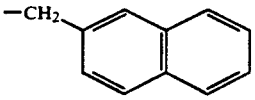 |
| 40 | (A)-40 | 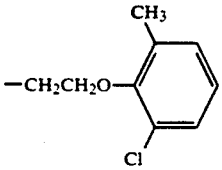 |
TABLE 3-continued
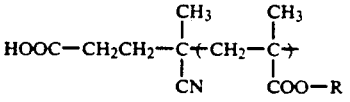
| Synthesis Example A No. | Resin (A) | Ester Substituent R |
|---|---|---|
| 41 | (A)-41 | 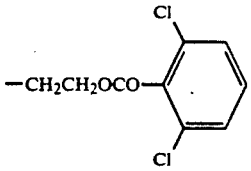 |
| 42 | (A)-42 | 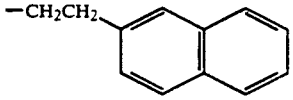 |
| 43 | (A)-43 | 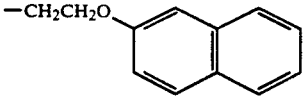 |
| 44 | (A)-44 | 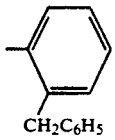 |
| 45 | (A)-45 | 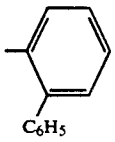 |
| 46 | (A)-46 | 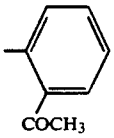 |
| 47 | (A)-47 | 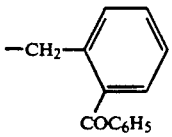 |
| 48 | (A)-48 | 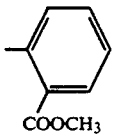 |
| 49 | (A)-49 | 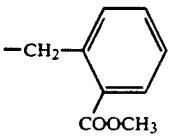 |

TABLE 3-continued

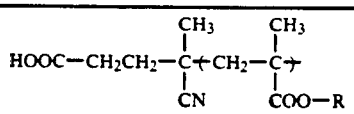

| Synthesis Example A No. | Resin (A) | Ester Substituent R |
|---|---|---|
| 50 | (A)-50 | 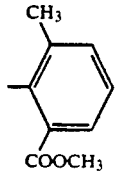 |

Structure of Resin (A)-51:

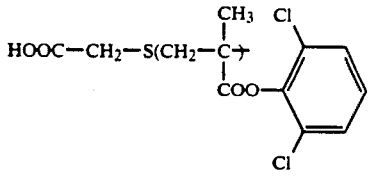

SYNTHESIS EXAMPLES A-52 TO A-57

Synthesis of Resins (A)-52 to (A)-57

Resins (A)-52 to (A)-57 shown in Table 4 below were synthesized in the same manner as in Synthesis Example A-51, except for replacing thioglycolic acid with each of the compounds shown in Table 4 below.

TABLE 4

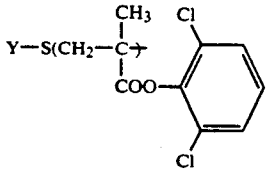

| Synthesis Example A No. | Resin (A) | Y | Chain Transfer Agent | Mw of Resin (A) |
|---|---|---|---|---|
| 52 | (A)-52 | $HOOC\text{-}(CH_2)_2\text{-}$ | $HS\text{-}(CH_2)_2\text{-}COOH$ | 8,100 |
| 53 | (A)-53 | $HOOC\text{-}CH(HOOC\text{-}CH_2)\text{-}$ | $HS\text{-}CH(CH_2\text{-}COOH)\text{-}COOH$ | 8,500 |
| 54 | (A)-54 | 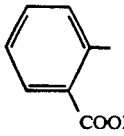 | 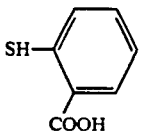 | 7,800 |
| 55 | (A)-55 | $HO_3S\text{-}(CH_2)_2\text{-}$ | $HO\text{-}(CH_2)_2\text{-}SO_3H$ | 8,000 |
| 56 | (A)-56 | $HO\text{-}P(=O)(OH)\text{-}O\text{-}(CH_2)_3\text{-}$ | $HS\text{-}(CH_2)_3\text{-}O\text{-}P(=O)(OH)\text{-}OH$ | 7,500 |
| 57 | (A)-57 | $HO\text{-}P(=O)(OC_2H_5)\text{-}O\text{-}(CH_2)_3\text{-}$ | $HS\text{-}(CH_2)_3\text{-}O\text{-}P(=O)(OC_2H_5)\text{-}OH$ | 7,600 |

SYNTHESIS EXAMPLE A-51

Synthesis of Resin (A)-51

A solution of a mixture of 97 g of 2,6-dichlorophenyl methacrylate, 3 g of thioglycolic acid, 150 g of toluene, and 50 g of isopropanol was heated to 65° C. in a nitrogen stream, and 0.8 g of AIBN was added thereto, and the reaction was conducted for 8 hours. The resulting Resin (A)-51 had an Mw of 7,800 and a glass transition temperature of 36° C.

SYNTHESIS EXAMPLE M-1

Synthesis of Macromonomer (M)-1

A solution of a mixture of 95 g of methyl methacrylate, 5 g of thioglycolic acid, and 200 g of toluene was heated to 75° C. in a nitrogen stream while stirring, 1.0 g of ACV was added thereto, and the reaction was conducted for 8 hours. To the reaction solution were added 8 g of glycidyl methacrylate, 1.0 g of N,N-dimethyldodecylamine, and 0.5 g of t-butylhydroquinone, followed by stirring at 100° C. for 12 hours. After cooling, the reaction solution was reprecipitated in 2 liters of methanol to obtain 82 g of a white powder. The resulting Macromonomer (M)-1 had a number average molecular weight (hereinafter referred to as Mn) of 6,500.

SYNTHESIS EXAMPLE M-2

Synthesis of Macromonomer (M)-2

A solution of a mixture of 95 g of methyl methacrylate, 5 g of thioglycolic acid, and 200 g of toluene was heated to 70° C. in a nitrogen stream while stirring, 1.5 g of AIBN was added thereto, and the reaction was conducted for 8 hours. To the reaction solution were added 7.5 g of glycidyl methacrylate, 1.0 g of N,N-dimethyldodecylamine, and 0.8 g of t-butylhydroquinone, followed by stirring at 100° C. for 12 hours. After cooling., the reaction solution was reprecipitated in 2 liters of methanol to obtain 85 g of a colorless transparent and viscous substance. The resulting Macromonomer (M)-2 had an Mn of 2,400.

SYNTHESIS EXAMPLE M-3

Synthesis of Macromonomer (M)-3

A solution of a mixture of 94 g of propyl methacrylate, 6 g of 2-mercaptoethanol, and 200 g of toluene was heated to 70° C. in a nitrogen stream, 1.2 g of AIBN was added thereto, and the reaction was conducted for 8 hours.

The reaction solution was cooled to 20° C. in a water bath, and 10.2 g of triethylamine was added thereto. To the solution was further added dropwise 14.5 g of methacrylic acid chloride at a temperature of 25° C. or lower while stirring. After the dropwise addition, the stirring was continued for an additional 1 hour. Then, 0.5 g of t-butylhydroquinone was added thereto, and the mixture was heated to 60° C., followed by stirring for 4 hours. After cooling, the reaction solution was reprecipitated in 2 liters of methanol to obtain 79 g of a colorless transparent and viscous substance. The resulting Macromonomer (M)-3 had an Mn of 4,500.

SYNTHESIS EXAMPLE M-4

Synthesis of Macromonomer (M)-4

A solution of a mixture of 95 g of ethyl methacrylate and 200 g of toluene was heated to 70° C. in a nitrogen stream, 5 g of 2,2'-azobis(cyanoheptanol), followed by allowing to react for 8 hours. After allowing to cool, the reaction mixture was cooled to 20° C. in a water bath, and 1.0 g of triethylamine and 21 g of methacrylic anhydride were added thereto. The mixture was stirred at that temperature for 1 hour and then at 60° C. for 6 hours.

The resulting reaction solution was cooled and reprecipitated in 2 liters of methanol to obtain 75 g of a colorless transparent and viscous substance. The resulting Macromonomer (M)-4 had an Mn of 6,200.

SYNTHESIS EXAMPLE M-5

Synthesis of Macromonomer (M)-5

A solution of a mixture of 93 g of benzyl methacrylate, 7 g of 3-mercaptopropionic acid, 170 g of toluene, and 30 g of isopropanol was heated to 70° C. in a nitrogen stream to form a uniform solution. To the solution was added 2.0 g of AIBN, followed by reacting for 8 hours. After cooling, the reaction solution was reprecipitated in 2 liters of methanol and then heated to 50° C. under reduced pressure to distill off the solvent. The residual viscous substance was dissolved in 200 g of toluene, and 16 g of glycidyl methacrylate, 1.0 g of N,N-dimethyldodecyl methacrylate, and 1.0 g of t-butylhydroquinone were added to the solution, followed by stirring at 110° C. for 10 hours. The reaction solution was again poured into 2 liters of methanol for reprecipitation. The resulting pale yellow viscous Macromonomer (M)-5 had an Mn of 3,400.

SYNTHESIS EXAMPLE M-6

Synthesis of Macromonomer (M)-6

A solution of a mixture of 95 g of propyl methacrylate, 5 g of thioglycolic acid, and 200 g of toluene was heated to 70° C. in a nitrogen stream while stirring, and 1.0 g of AIBN was added thereto, followed by reacting for 8 hours. Then, 13 g of glycidyl methacrylate, 1.0 g of N,N-dimethyldodecylamine, and 1.0 g of t-butylhydroquinone were added to the reaction solution, followed by stirring at 110° C. for 10 hours. After cooling, the reaction solution was reprecipitated in 2 liters of methanol to obtain 86 g of a white powder. The resulting Macromonomer (M)-6 had an Mn of 3,500.

SYNTHESIS EXAMPLE M-7

Synthesis of Macromonomer (M)-7

A mixture of 40 g of methyl methacrylate, 54 g of ethyl methacrylate, 6 g of 2-mercaptoethylamine, 150 g of toluene, and 50 g of tetrahydrofuran was heated to 75° C. in a nitrogen stream while stirring. To the solution was added 2.0 g of AIBN and the reaction was conducted for 8 hours. The reaction solution was cooled to 20° C. in a water bath, and 23 g of methacrylic anhydride was added thereto dropwise taking care not to raise the temperature above 25° C. The stirring at that temperature was further continued for an additional 1 hour. To the reaction solution was added 0.5 g of 2,2'-methylenebis(6-t-butyl-p-cresol), followed by stirring at 40° C. for 3 hours. After cooling, the solution was reprecipitated in 2 liters of methanol to obtain 83 g of a viscous substance. The resulting Macromonomer (M)-7 had an Mn of 2,200.

SYNTHESIS EXAMPLE M-8

Synthesis of Macromonomer (M)-8

A solution of a mixture of 95 g of methyl methacrylate, 150 g of toluene, and 150 g of ethanol was heated to 75° C. in a nitrogen stream, 5 g of ACV was added thereto, and the reaction was conducted for 8 hours. Then, 15 g of glycidyl acrylate, 1.0 g of N,N-dimethyldodecylamine, and 1.0 g of 2,2'-methylenebis(6-t-butyl-p-cresol) were added to the reaction solution, followed by stirring at 100° C. for 15 hours. After cooling, the reaction solution was reprecipitated in 2 liters of methanol to obtain 83 g of a transparent viscous substance. The resulting Macromonomer (M)-8 had an Mn of 3,600.

SYNTHESIS EXAMPLES M-9 TO M-18

Synthesis of Macromonomers (M)-9 to (M)-18

Macromonomers (M)-9 to (M)-18 shown in Table 5 below were synthesized in the same manner as in Synthesis Example M-3, except for replacing methacrylic acid chloride with each of the acid halides shown in Table 5 below.

The resulting Macromonomers (M)-9 to (M)-18 had an Mn between 4,000 and 5,000.

TABLE 5

| Synthesis Example M No. | Macro-monomer (M) | Acid Halide | Amount of Acid Halide (g) | Yield (g) |
|---|---|---|---|---|
| 9 | (M)-9 | $CH_2=CH-COCl$ | 13.5 | 75 |
| 10 | (M)-10 | $CH_3$<br>\|<br>$CH=CH-COCl$ | 14.5 | 80 |
| 11 | (M)-11 | 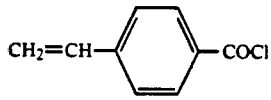 | 15.0 | 83 |
| 12 | (M)-12 | $CH_2=CH$<br>\|<br>$COO(CH_2)_2COCl$ | 15.5 | 73 |
| 13 | (M)-13 | $CH_3$<br>\|<br>$CH_2=C$<br>\|<br>$COO(CH_2)_2OCO(CH_2)_2COCl$ | 18.0 | 75 |
| 14 | (M)-14 | $CH_3$<br>\|<br>$CH_2=C$<br>\|<br>$CONH(CH_2)_4COCl$ | 18.0 | 80 |
| 15 | (M)-15 | 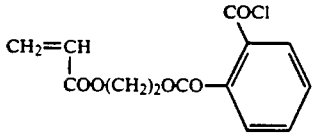 | 20.0 | 81 |
| 16 | (M)-16 | $CH_3$<br>\|<br>$CH_2=C$ Br<br>\| \|<br>$COOCH_2CHCH_2OCO(CH_2)_3COCl$ | 20.0 | 78 |
| 17 | (M)-17 | $CH_2=CH-CH_2$<br>\|<br>$OCO(CH_2)_2COCl$ | 16.0 | 72 |
| 18 | (M)-18 | $CH_2=C-COCl$<br>\|<br>$CH_2COOCH_3$ | 17.5 | 75 |

SYNTHESIS EXAMPLES M-19 TO M-27

Synthesis of Macromonomers (M)-19 to (M)-27

Macromonomers (M)-19 to (M)-27 were synthesized in the same manner as in Synthesis Example M-2, except for replacing methyl methacrylate with each of the monomers or monomer mixtures shown in Table 6 below.

TABLE 6

| Synthesis Example M No. | Macro-monomer (M) | Monomer (weight) | Mw |
|---|---|---|---|
| 19 | (M)-19 | Ethyl methacrylate (95 g) | 2,800 |
| 20 | (M)-20 | Methyl methacrylate (60 8)<br>Butyl methacrylate (35 g) | 3,200 |
| 21 | (M)-21 | Butyl methacrylate (85 g)<br>2-Hydroxyethyl methacrylate (10 g) | 3,300 |
| 22 | (M)-22 | Ethyl methacrylate (75 g)<br>Styrene (20 g) | 2,200 |
| 23 | (M)-23 | Methyl methacrylate (80 g)<br>Methyl acrylate (15 g) | 2,500 |
| 24 | (M)-24 | Ethyl acrylate (75 g)<br>Acrylonitrile (20 g) | 3,000 |
| 25 | (M)-25 | Propyl methacrylate (87 g)<br>N,N-Dimethylaminoethyl methacrylate (8 g) | 2,200 |
| 26 | (M)-26 | Butyl methacrylate (90 g)<br>N-Vinylpyrrolidone (5 g) | 3,100 |
| 27 | (M)-27 | Methyl methacrylate (89 g)<br>Dodecyl methacrylate (6 g) | 3,000 |

SYNTHESIS EXAMPLE B-1

Synthesis of Resin (B)-1

A solution of a mixture of 70 g of ethyl methacrylate, 30 g of Macromonomer (M)-1, and 150 g of toluene was heated to 70° C. in a nitrogen stream, 0.5 g of AIBN was added thereto, and the reaction was conducted for 4 hours. To the reaction solution was added 0.3 g of AIBN, followed by reacting for 6 hours. The resulting Resin (B)-1 had an Mw of $9.8\times10^4$ and a glass transition point of 72° C.

Structure of Resin (B)-1:

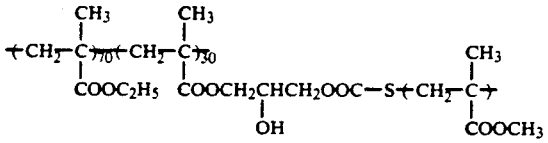

(copolymerization ratio: by weight)

SYNTHESIS EXAMPLES B-2 TO B-15

Synthesis of Resins (B)-2 to (B)-15

Resins (B)-2 to (B)-15 in Table 7 were synthesized under the same polymerization conditions as in Synthesis Example M-1. The resulting Resins (B)-2 to (B)-15 had an Mw between $8\times10^4$ and $1.5\times10^5$.

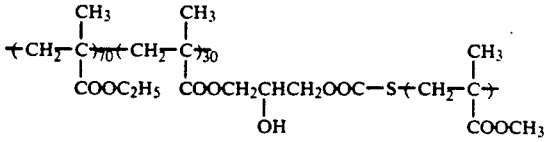

(copolymerization ratio: by weight)

SYNTHESIS EXAMPLES B-2 TO B-15

Synthesis of Resins (B)-2 to (B)-15

Resins (B)-2 to (B)-15 in Table 7 were synthesized under the same polymerization conditions as in Synthesis Example M-1. The resulting Resins (B)-2 to (B)-15 had an Mw between $8\times10^4$ and $1.5\times10^5$.

TABLE 7

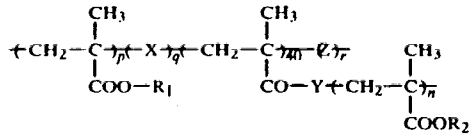

| Synthesis Example B No. | Resin (B) | $R_1$ | p | (X) | q | Y | $R_2$ | Z | r |
|---|---|---|---|---|---|---|---|---|---|
| 2 | (B)-2 | $-CH_3$ | 60 | — | 0 | $-OCH_2CH(OH)CH_2OOC-CH_2-S-$ | $-C_4H_9$ | — | 0 |
| 3 | (B)-3 | $-CH_3$ | 60 | — | 0 | " | $-C_3H_7$ | — | 0 |
| 4 | (B)-4 | $-C_2H_5$ | 60 | — | 0 | " | $-C_2H_5$ | — | 0 |
| 5 | (B)-5 | $-C_2H_5$ | 50 | $+CH_2-CH+$ (C6H5) | 10 | $-OCH_2CH(OH)CH_2OOC-CH_2-S-$ | $-C_2H_5$ | — | 0 |
| 6 | (B)-6 | $-CH_3$ | 50 | $+CH_2-CH+$ ($COOCH_3$) | 10 | $-OCH_2CH(OH)CH_2OOC-CH_2-S-$ | $-C_2H_5$ | — | 0 |
| 7 | (B)-7 | $-CH_2C_6H_5$ | 60 | — | 0 | " | " | — | 0 |
| 8 | (B)-8 | $-C_2H_5$ | 59.2 | — | 0 | " | " | $+CH_2-CH+$ ($COOH$) | 0.8 |
| 9 | (B)-9 | $-C_2H_5$ | 45 | $+CH_2-CH+$ ($CN$) | 15 | $-OCH_2CH_2-S-$ | " | — | 0 |
| 10 | (B)-10 | $-CH_3$ | 49.5 | $+CH_2-CH+$ (C6H5) | 10 | $-NHCH_2CH_2-S-$ | $-C_4H_9$ | $+CH_2-C(CH_3)+$ ($COOH$) | 0.5 |
| 11 | (B)-11 | $-C_2H_5$ | 57 | — | 0 | $-OCH_2CH(OH)CH_2OOC-CH_2CH_2-C(CH_3)(CN)-$ | $-CH_2C_6H_6$ | $+CH_2-C(CH_3)+$ ($COOCH_2CH_2OH$) | 3 |

TABLE 7-continued

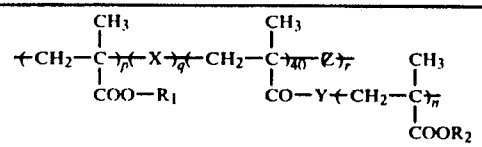

| Synthesis Example B No. | Resin (B) | $R_1$ | p | (X) | q | Y | $R_2$ | Z | r |
|---|---|---|---|---|---|---|---|---|---|
| 12 | (B)-12 | $-C_3H_7$ | 47 | $\leftarrow CH_2-C(CH_3)(COOCH_2CH_2CN)\rightarrow$ | 15 | $-OCH_2CH(OH)CH_2OOC-CH_2CH_2-C(CH_3)(CN)-$ | $-C_2H_5$ | — | 0 |
| 13 | (B)-13 | $-C_2H_5$ | 40 | $\leftarrow CH_2-C(CH_3)(COO-C_6H_5)\rightarrow$ | 15 | $-OCH_2-C(CH_3)(CN)-$ | $-C_3H_7$ | $\leftarrow CH_2-C(CH_3)(CONH_2)\rightarrow$ | 5 |
| 14 | (B)-14 | $-CH_3$ | 49.5 | $\leftarrow CH_2-C(COOCH_3)(CH_2COOCH_3)\rightarrow$ | 10 | $-OCH_2CH_2CH_2-C(CH_3)(CN)-$ | $-C_4H_9$ | $\leftarrow CH_2-CH(CONHCH_2C(CH_3)(CH_2SO_3H))\rightarrow$ | 0.5 |
| 15 | (B)-15 | $-C_3H_7$ | 50 | $\leftarrow CH_2-CH(C_6H_5)\rightarrow$ | 10 | $-OCH_2CH(OH)CH_2OOC-CH_2CH_2-S-$ | $-C_6H_5$ | — | 0 |

SYNTHESIS EXAMPLE B-16

Synthesis of Resin (B)-16

A solution of a mixture of 70 g of ethyl methacrylate, 30 g of Macromonomer (M)-2, 150 g of toluene, and 50 g of isopropanol was heated to 70° C. in a nitrogen stream, and 0.8 g of ACV was added thereto, followed by reacting for 10 hours. The resulting Resin (B)-16 had an Mw of $9.8\times10^4$ and a glass transition point of 72° C.

Structure of Resin (B)-16:

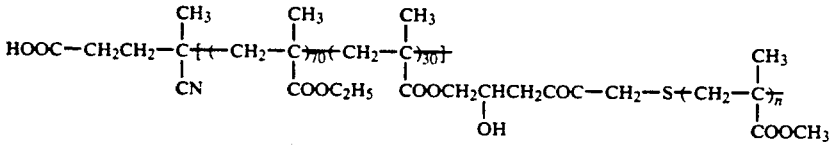

SYNTHESIS EXAMPLES B-17 TO B-24

Synthesis of Resins (B)-17 to (B)-24

Resins (B)-17 to (B)-24 shown in Table 8 below were synthesized in the same manner as in Synthesis Example B-16, except for replacing Macromonomer (M)-2 with each of the Macromonomer (M) shown in Table 8 below. The resulting Resins (B)-17 to (B)-24 had an Mw of from $9\times10^4$ to $1.2\times10^5$.

TABLE 8

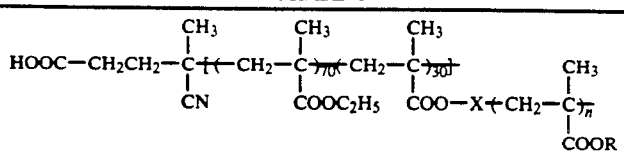

| Synthesis Example B No. | Resin (B) | Macromonomer (M) | —X— | —R |
|---|---|---|---|---|
| 17 | (B)-17 | (M)-3 | $-CH_2CH_2-S-$ | $-C_4H_9$ |
| 18 | (B)-18 | (M)-4 | $-CH_2CH_2CH_2C(CH_3)(CN)-$ | $-C_2H_5$ |
| 19 | (B)-19 | (M)-5 | $-CH_2CH_2-S-$ | $-CH_2C_6H_5$ |
| 20 | (B)-20 | (M)-6 | $-CH_2CH(OH)CH_2OOC-CH_2-S-$ | $-C_3H_7$ |
| 21 | (B)-21 | (M)-28 | $-CH_2CH(OH)CH_2OOC-CH_2-S-$ | $-C_2H_5$ |
| 22 | (B)-22 | (M)-29 | " | $-C_4H_9$ |
| 23 | (B)-23 | (M)-30 | " | $-CH_2C_6H_5$ |
| 24 | (B)-24 | (M)-32 | " | $-C_6H_5$ |

SYNTHESIS EXAMPLES B-25 TO B-31

Synthesis of Resins (B)-25 to (B)-31

Resins (B)-25 to (B)-31 in Table 9 were synthesized in the same manner as in Synthesis Example B-16, except for replacing ACV with each of the azobis compounds shown in Table 9 below.

TABLE 9

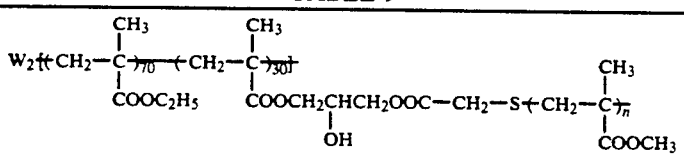

| Synthesis Example B No. | Resin (B) | Azobis Compound | $W_2$— | Mw |
|---|---|---|---|---|
| 25 | (B)-25 | 2,2'-Azobis(2-cyanopropanol) | $HOCH_2-C(CH_3)(CN)-$ | $10.5\times10^4$ |

TABLE 9-continued

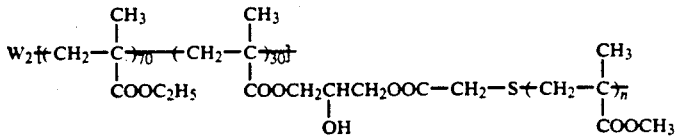

| Synthesis Example B No. | Resin (B) | Azobis Compound | $W_2$— | Mw |
|---|---|---|---|---|
| 26 | (B)-26 | 2,2'-Azobis(4-cyanoheptanol) | 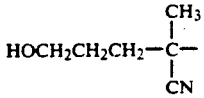 | $10 \times 10^4$ |
| 27 | (B)-27 | 2,2'-Azobis[2-methyl-N-[1,1-bis-(hydroxymethyl)-2-hydroxyethyl]-propionamide | 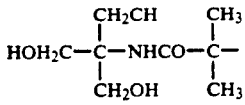 | $9 \times 10^4$ |
| 28 | (B)-28 | 2,2'-Azobis[2-methyl-N-(2-hydroxyethyl)]propionamide | 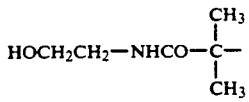 | $9.5 \times 10^4$ |
| 29 | (B)-29 | 2,2'-Azobis[2-methyl-N-[1,1-bis-(hydroxymethyl)ethyl]propionamide | 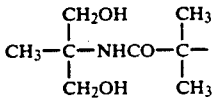 | $8.5 \times 10^4$ |
| 30 | (B)-30 | 2,2'-Azobis[2-(5-hydroxy-3,4,5,6-tetrahydropyrimidin-2-yl]propane | 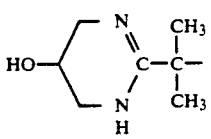 | $8.0 \times 10^4$ |
| 31 | (B)-31 | 2,2'-Azobis[2-[1-(2-hydroxy-ethyl)-2-imidazolin-2-yl]propane | 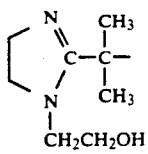 | $7.5 \times 10^4$ |

SYNTHESIS EXAMPLE B-32

Synthesis of Resin (B)-32

A solution of a mixture of 80 g of butyl methacrylate, 20 g of Macromonomer (M)-8, 1.0 g of thioglycolic acid, 100 g of toluene, and 50 g of isopropanol was heated to 80° C. in a nitrogen stream, and 0.5 g of 1,1-azobis(cyclohexane-1-carbonitrile) (hereinafter abbreviated as ACHN) was added thereto, followed by stirring for 4 hours. The resulting Resin (B)-32 had an Mw of $8.0 \times 10^4$ and a glass transition point of 41° C.

Structure of Resin (B)-32

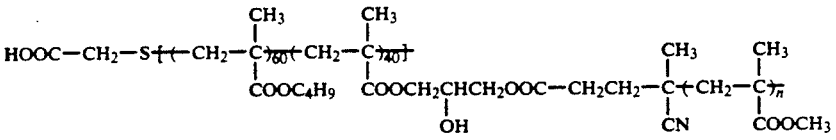

SYNTHESIS EXAMPLES B-33 TO B-39

Synthesis of Resins (B)-33 to (B)-39

Resins (B)-33 to (B)-39 shown in Table 10 below were synthesized in the same manner as in Synthesis Example B-32, except for replacing thioglycolic acid with each of the mercaptan compounds shown in Table 10 below.

TABLE 10

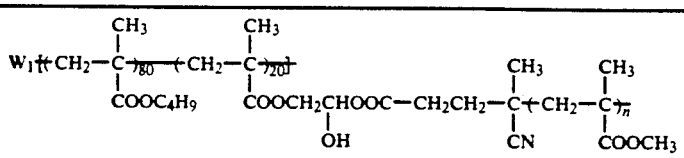

| Synthesis Example B No. | Resin (B) | Mercaptan Compound | $W_1$— | Mw |
|---|---|---|---|---|
| 33 | (B)-33 | 3-Mercaptopropionic acid | $HOOC-CH_2CH_2-S-$ | $8.5 \times 10^4$ |
| 34 | (B)-34 | 2-Mercaptosuccinic acid | $HOOC-HC(HOOC-CH_2)-S-$ | $10 \times 10^4$ |
| 35 | (B)-35 | Thiosalicylic acid | 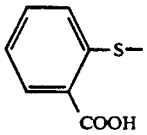 | $9 \times 10^4$ |
| 36 | (B)-36 | Pyridine 2-mercaptoethane-sulfonate | 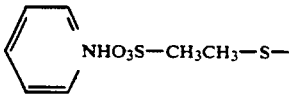 | $8 \times 10^4$ |
| 37 | (B)-37 | $HSCH_2CH_2CONHCH_2COOH$ | $HOOCH_2CNHCOCH_2CH_2-S-$ | $9.5 \times 10^4$ |
| 38 | (B)-38 | 2-Mercaptoethanol | $HO-CH_2CH_2-S-$ | $9 \times 10^4$ |
| 39 | (B)-39 | $HSCH_2CH_2COOCH_2CH_2-O-P(=O)(OH)-OH$ | $HO-P(=O)(OH)-OCH_2CH_2COCCH_2CH_2-S-$ | $10.5 \times 10^4$ |

SYNTHESIS EXAMPLES B-40 TO B-48

Synthesis of Resins (B)-40 to (B)-48

Resins (B)-40 to (B)-48 in Table 11 below were synthesized under the same polymerization conditions as in Synthesis Example B-26. The resulting Resins (B)-40 to (B)-48 had an Mw between $9.5 \times 10^4$ to $1.2 \times 10^5$.

TABLE 11

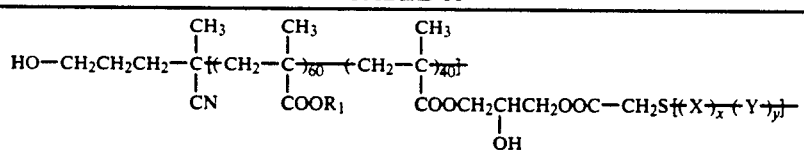

| Synthesis Example B No. | Resin (B) | $R_1$ | X | x | Y | y |
|---|---|---|---|---|---|---|
| 40 | (B)-40 | $-C_2H_5$ | 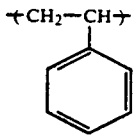 | 20 | 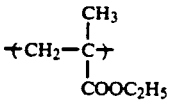 | 80 |
| 41 | (B)-41 | $-C_2H_5$ | 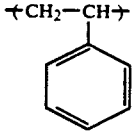 | 40 | 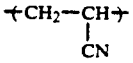 | 60 |
| 42 | (B)-42 | $-C_2H_5$ | 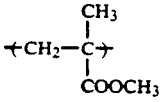 | 90 | 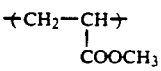 | 10 |

TABLE 11-continued

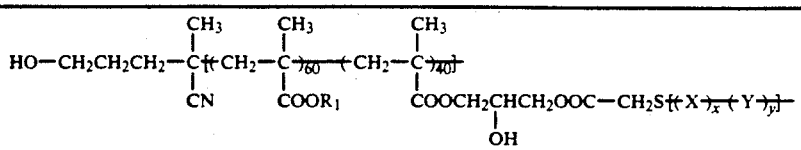

| Synthesis Example B No. | Resin (B) | $R_1$ | X | x | Y | y |
|---|---|---|---|---|---|---|
| 43 | (B)-43 | $-C_3H_7$ | 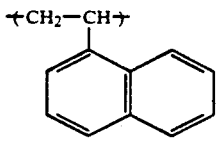 | 100 | — | 0 |
| 44 | (B)-44 | $-C_3H_7$ | $\leftarrow CH_2-C(CH_3)(COOCH_2CH_2CN)\rightarrow$ | 50 | $\leftarrow CH_2-C(CH_3)(COOC_4H_9)\rightarrow$ | 50 |
| 45 | (B)-45 | $-C_2H_5$ | $\leftarrow CH_2-C(CH_3)(COOC_3H_7)\rightarrow$ | 85 | $\leftarrow CH_2-C(CH_3)(COOCH_2CH_2N(CH_3)_2)\rightarrow$ | 75 |
| 46 | (B)-46 | $-C_2H_5$ | $\leftarrow CH_2-C(CH_3)(COOC_2H_5)\rightarrow$ | 90 | 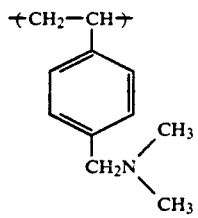 | 10 |
| 47 | (B)-47 | $-C_3H_7$ | $\leftarrow CH_2-C(CH_3)(COOC_2H_5)\rightarrow$ | 90 | $\leftarrow CH_2-C(CH_3)(COOCH_2CH_2SO_2CH_3)\rightarrow$ | 10 |
| 48 | (B)-48 | $-C_2H_5$ | $\leftarrow CH_2-C(CH_3)(COOC_3H_7)\rightarrow$ | 75 | $\leftarrow CH_2-C(CH_3)(CONH_2)\rightarrow$ | 15 |

SYNTHESIS EXAMPLES B-49 TO B-56

Synthesis of Resins (B)-49 to (B)-56

Resins (B)-49 to (B)-56 in Table 12 below were synthesized under the same polymerization conditions as in Synthesis Example B-16. The resulting Resins (B)-49 to (B)-56 had an Mw between $9\times10^4$ to $1.1\times10^5$.

TABLE 12

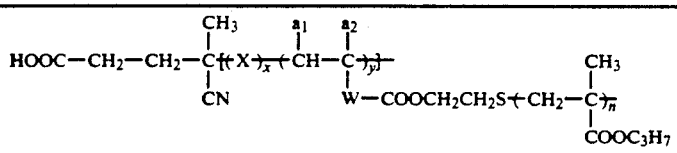

| Synthesis Example B No. | Resin (B) | —X— | $a_1$ | $a_2$ | —W— | x/y (by weight) | Macro-monomer (M) used |
|---|---|---|---|---|---|---|---|
| 49 | (B)-49 | $-CH_2-C(CH_3)(COOC_2H_5)-$ | H | H | — | 80/20 | (M)-9 |
| 50 | (B)-50 | " | $CH_3$ | H | — | 70/30 | (M)-10 |

TABLE 12-continued

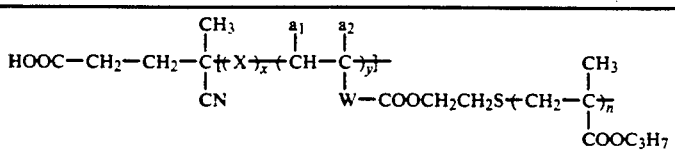

| Synthesis Example B No. | Resin (B) | —X— | $a_1$ | $a_2$ | —W— | x/y (by weight) | Macro-monomer (M) used |
|---|---|---|---|---|---|---|---|
| 51 | (B)-51 | 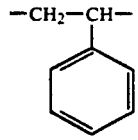 | H | H | 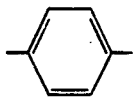 | 60/40 | (M)-11 |
| 52 | (B)-52 | $-CH_2-C(CH_3)(COOC_2H_5)-$ | H | H | $-COOCH_2CH_2-$ | 80/20 | (M)-12 |
| 53 | (B)-53 | $-CH_2-C(CH_3)(COOC_2H_5)-$ | H | $CH_3$ | $-COO(CH_2)_2OCO(CH_2)_2-$ | 80/20 | (M)-13 |
| 54 | (B)-54 | $-CH_2-C(CH_3)(COOCH_2C_6H_5)-$ | H | $CH_3$ | $-CONH(CH_2)_4-$ | 80/20 | (M)-14 |
| 55 | (B)-55 | $-CH_2-C(CH_3)(COOCH_3)-$ | H | H | 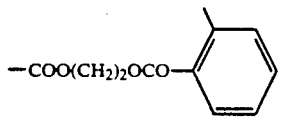 | 50/50 | (M)-15 |
| 56 | (B)-56 | 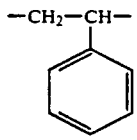 | H | H | $-CH_2OCO(CH_2)_2-$ | 80/20 | (M)-17 |

EXAMPLE 1

A mixture of 6 g (solid basis) of Resin (A)-1 as synthesized in Synthesis Example A-1, 34 g (solid basis) of Resin (B)-1 as synthesized in Synthesis Example B-1, 200 g of zinc oxide, 0.018 g of Cyanine Dye (A) shown below, 0.05 g of phthalic anhydride, and 300 g of toluene was dispersed in a ball mill for 2 hours to prepare a photoconductive coating composition. The composition was coated on paper, rendered electrically conductive, with a wire bar to a dry thickness of 22 g/m$^2$, followed by drying at 110° C. for 30 seconds. The coating was allowed to stand in a dark place at 20° C. and 65% RH (relative humidity) for 24 hours to produce an electrophotographic photoreceptor.

Cyanine Dye (A)

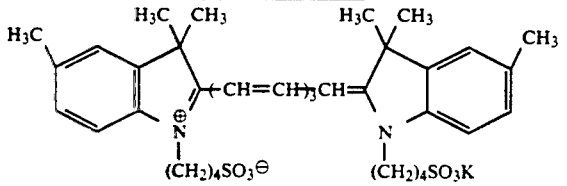

EXAMPLE 2

An electrophotographic photoreceptor was produced in the same manner as in Example 1, except for using 34 g of Resin (B)-16 in place of Resin (B)-1.

COMPARATIVE EXAMPLE 1

An electrophotographic photoreceptor was produced in the same manner as in Example 1, except for replacing Resin (A)-1 and Resin (B)-1 with 40 g (on a solids basis) of Resin (A)-1 alone. The resulting Photoreceptor was designated Sample A.

COMPARATIVE EXAMPLE 2

An electrophotographic photoreceptor (Sample B) was produced in the same manner as in Example 1, except for using 40 g of Resin (R)-1 shown below in place of Resin (A)-1 and Resin (B)-1.

Resin (R)-1

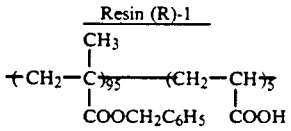

-continued

Resin (R)-1

(copolymerization ratio: by weight; Mw: 6,500)

COMPARATIVE EXAMPLE 3

An electrophotographic photoreceptor (Sample C) was produced in the same manner as in Example 1, except for replacing Resin (A)-1 with 6 g of Resin (R)-1 and 34 g of Resin (B)-1.

COMPARATIVE EXAMPLE 4

An electrophotographic photoreceptor (Sample D) was produced in the same manner as in Example 1, except for using 40 g of Resin (R)-2 shown below in place of Resin (A)-1 and Resin (B)-1.

Resin (R)-2

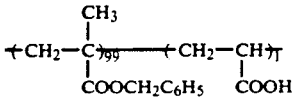

(copolymerization ratio: by weight; Mw: 45,000)

The film properties (in terms of surface smoothness and mechanical strength), electrostatic characteristics and image-forming performance of each of the photoreceptors obtained in Examples 1 and 2 and Comparative Examples 1 to 4 were evaluated in accordance with the following test methods. Further, the photoconductive layer oil desensitivity (in terms of contact angle with water after oil desensitization) and printing suitability (in terms of stain resistance and printing durability) of the photoreceptor when used as an offset master plate precursor were evaluated in accordance with the following test methods. The results obtained are shown in Table 13 below.

1) Smoothness of Photoconductive Layer

The smoothness (sec/cc) was measured using a Beck's smoothness tester manufactured by Kumagaya Riko K.K. under an air volume condition of 1 cc.

2) Mechanical Strength of Photoconductive Layer

The surface of the photoreceptor was repeatedly rubbed with emery paper (#1000) under a load of 50 g/cm$^2$ using a Heidon 14 Model surface testing machine (manufactured by Shinto Kagaku K.K.). After dusting, the abrasion loss of the photoconductive layer was measured to obtain film retention (%).

3) Electrostatic Characteristics

The sample was charged with a corona discharge to a voltage of −6 kV for 20 seconds in a dark room at 20° C. and 65% RH using a paper analyzer ("Paper Analyzer SP-428" manufactured by Kawaguchi Denki K.K.). Ten seconds after the corona discharge, the surface potential $V_{10}$ was measured. The sample was allowed to stand in dark for an additional 90 seconds, and the potential $V_{100}$ was measured. The dark decay retention (DRR; %), i.e., percent retention of potential after dark decay for 90 seconds, was calculated from the following:

$$DRR\ (\%) = (V_{100}/V_{10}) \times 100$$

Separately, the sample was charged to −400 V with a corona discharge and then exposed to monochromatic light having a wavelength of 780 nm, and the time required for decay of the surface potential $V_{10}$ to one-tenth was measured to obtain an exposure $E_{1/10}$ (erg/cm$^2$).

The measurements were conducted under conditions of 20° C. and 65% RH (hereinafter referred to as Condition I) or 30° C. and 80% RH (hereinafter referred to as Condition II).

Image Forming Performance

After the samples were allowed to stand for one day under Condition I or Condition II, each sample was charged to −6 kV and exposed to light emitted from a gallium-aluminum-arsenic semiconductor laser (oscillation wavelength: 750 nm; output: 2.8 mW) at an exposure of 64 erg/cm$^2$ (on the surface of the photoconductive layer) at a pitch of 25 μm and a scanning speed of 300 m/sec. The electrostatic latent image was developed with a liquid developer ("ELP-T" produced by Fuji Photo Film Co., Ltd.), followed by fixing. The reproduced image was visually evaluated for fog and image quality.

5) Contact Angle with Water

The sample was passed once through an etching processor using an oil-desensitizing solution ("ELP-E" produced by Fuji Photo Film Co., Ltd.) to render the surface of the photoconductive layer oil-desensitive. On the thus oil-desensitized surface was placed a drop of 2 μl of distilled water, and the contact angle formed between the surface and the water was measured using a goniometer.

6) Printing Durability

The sample was processed in the same manner as described in 4) above, and the surface of the photoconductive layer was subjected to oil desensitization under the same conditions as in 5) above. The resulting lithographic printing plate was mounted on an offset printing machine ("Oliver Model 52", manufactured by Sakurai Seisakusho K.K.), and printing was carried out on fine paper. The number of prints obtained until background stains in the nonimage areas appeared or the quality of the image areas was deteriorated was taken as the printing durability. The larger the number of the prints, the higher the printing durability.

TABLE 13

| | Example | | Comparative Example | | | |
|---|---|---|---|---|---|---|
| | 1 | 2 | 1 | 2 | 3 | 4 |
| Surface Smoothness (sec/cc) | 93 | 89 | 92 | 88 | 90 | 34 |
| Film Strength (%) | 88 | 94 | 64 | 60 | 92 | 70 |
| $V_{10}$ (−V): | | | | | | |
| Condition I | 555 | 565 | 550 | 540 | 545 | 490 |
| Condition II | 540 | 550 | 545 | 450 | 450 | 220 |
| DRR (%): | | | | | | |
| Condition I | 80 | 81 | 82 | 80 | 80 | 46 |
| Condition II | 78 | 79 | 81 | 70 | 70 | 10 |
| $E_{1/10}$ (erg/cm$^2$): | | | | | | |
| Condition I | 32 | 30 | 29 | 48 | 49 | 89 |
| Condition II | 34 | 31 | 28 | 32 | 31 | — |

TABLE 13-continued

| | Example | | Comparative Example | | | |
|---|---|---|---|---|---|---|
| | 1 | 2 | 1 | 2 | 3 | 4 |
| Image Forming Performance: | | | | | | |
| Condition I | Good | Good | Good | Good | Good | Poor (DM was unmeasurable) |
| Condition II | Good | Good | Good | No good (fine lines undecipherable) | No good (fine lines undecipherable) | Very poor (cuts of fine lines or letters; DM unmeasurable) |
| Contact Angle with Water (°C.) | 11 | 12 | 10 | 10 | 11 | 25-30 (widely scattered) |
| Printing Durability | 8,000 | 10,000 or more | 3,000 | 3,000 | 10,000 or more | Background stains from the start of printing |

As can be seen from the results in Table 13, only Sample D using a known conventional binder resin had seriously deteriorated surface smoothness and electrostatic characteristics.

Samples B and C underwent reduction of electrostatic characteristics, particularly DRR, with the change of the environmental conditions to high temperature and high humidity conditions (30° C., 80% RH). The quality of the reproduced image obtained by scanning exposure was accordingly reduced.

Sample A underwent substantially no adverse influences of the change of the environmental conditions on electrostatic characteristics and image forming performance as observed in Samples B and C. Further, Sample A showed improvements over Sample B in electrostatic characteristics under normal temperature and normal humidity conditions, which improvements are very effective in processing according to a scanning exposure system using a low output semiconductor laser beam.

The photoreceptors according to the present invention had equal electrostatic characteristics and image forming performance to Sample A and also exhibited markedly improved photoconductive layer film strength. When used as an offset master plate precursor, oil desensitization with an oil-desensitizing solution was sufficient to render the nonimage areas sufficiently hydrophilic, as shown by a small contact angle of 15° or less with water. On practical printing using the resulting master plate, no background stains were observed in the prints at all. To the contrary, Sample A had insufficient printing durability due to poor film strength.

Of the photoreceptors of the present invention, the sample of Example 2 using Resin (B) containing a polar group showed an improvement in printing durability over the sample of Example 1.

From all these considerations, it is thus clear that the electrophotographic photoreceptors according to the present invention satisfied all the requirements of surface smoothness, film strength, electrostatic characteristics and printing suitability.

EXAMPLES 3 TO 22

An electrophotographic photoreceptor was produced in the same manner as in Example 1, except for replacing Resin (A)-1 and Resin (B)-1 with each of the Resins (A) and Resins (B) shown in Table 14, respectively, and replacing 0.018 g of Cyanine Dye (A) with 0.018 g of Cyanine Dye (B) shown below.

Cyanine Dye (B):

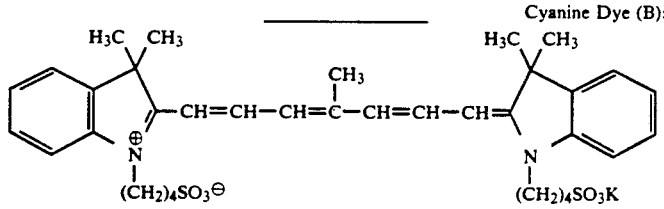

The performance properties of the resulting photoreceptors were evaluated in the same manner as in Example 1, and the results obtained are shown in Table 14 below. The electrostatic characteristics in Table 14 are those determined under Condition II (30° C., 80% RH).

TABLE 14

| Example No. | Resin (A) | Resin (B) | Film Strength (%) | Electrostatic Characteristics (Condition II) $V_{10}$ (−V) | DRR (%) | $E_{1/10}$ (erg/cm$^2$) | Printing Durability |
|---|---|---|---|---|---|---|---|
| 3 | (A)-2 | (B)-2 | 86 | 500 | 75 | 39 | 8,000 |
| 4 | (A)-3 | (B)-3 | 85 | 510 | 76 | 38 | 8,000 |
| 5 | (A)-4 | (B)-4 | 88 | 520 | 78 | 36 | 8,000 |
| 6 | (A)-5 | (B)-5 | 89 | 520 | 78 | 35 | 8,300 |
| 7 | (A)-6 | (B)-6 | 85 | 500 | 75 | 39 | 8,000 |
| 8 | (A)-7 | (B)-7 | 86 | 505 | 75 | 39 | 8,000 |
| 9 | (A)-8 | (B)-8 | 90 | 500 | 75 | 39 | 10,000 or more |
| 10 | (A)-9 | (B)-9 | 89 | 500 | 74 | 38 | 8,500 |
| 11 | (A)-10 | (B)-10 | 88 | 500 | 74 | 39 | 10,000 |

TABLE 14-continued

| Example No. | Resin (A) | Resin (B) | Film Strength (%) | Electrostatic Characteristics (Condition II) $V_{10}$ (−V) | DRR (%) | $E_{1/10}$ (erg/cm$^2$) | Printing Durability |
|---|---|---|---|---|---|---|---|
| 12 | (A)-11 | (B)-14 | 88 | 515 | 76 | 37 | or more 10,000 |
| 13 | (A)-13 | (B)-15 | 88 | 515 | 75 | 38 | or more 8,500 |
| 14 | (A)-15 | (B)-17 | 90 | 515 | 77 | 38 | 10,000 |
| 15 | (A)-17 | (B)-18 | 92 | 490 | 79 | 40 | or more 10,000 |
| 16 | (A)-18 | (8)-19 | 90 | 565 | 82 | 33 | or more 10,000 |
| 17 | (A)-19 | (B)-25 | 90 | 550 | 79 | 32 | or more 10,000 |
| 18 | (A)-22 | (B)-27 | 92 | 485 | 74 | 35 | or more 10,000 |
| 19 | (A)-23 | (B)-29 | 92 | 495 | 73 | 33 | or more 10,000 |
| 20 | (A)-24 | (B)-32 | 93 | 495 | 73 | 34 | or more 10,000 |
| 21 | (A)-25 | (B)-35 | 94 | 500 | 75 | 35 | or more 10,000 |
| 22 | (A)-26 | (B)-38 | 93 | 510 | 77 | 36 | or more 10,000 |

EXAMPLES 23 TO 36

An electrophotographic photoreceptor was produced in the same manner as in Example 1, except for replacing 6 g of Resin (A)-1 and 34 g of Resin (B)-1 with the equal amount of each of the Resins (A) and (B) shown in Table 15 below, respectively, and replacing 0.018 g of Cyan Dye (A) with 0.016 g of Methine Dye (C) shown below.

Methine Dye (C):

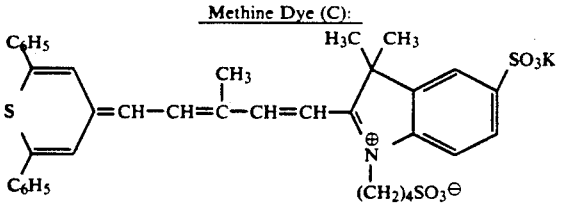

TABLE 15

| Example No. | Resin (A) | Resin (B) |
|---|---|---|
| 23 | (A)-12 | (B)-9 |
| 24 | (A)-14 | (B)-10 |
| 25 | (A)-16 | (B)-11 |
| 26 | (A)-20 | (B)-21 |
| 27 | (A)-21 | (B)-23 |
| 28 | (A)-6 | (B)-24 |
| 29 | (A)-6 | (B)-30 |
| 30 | (A)-7 | (B)-40 |
| 31 | (A)-7 | (B)-41 |
| 32 | (A)-9 | (B)-43 |
| 33 | (A)-18 | (B)-44 |
| 34 | (A)-19 | (B)-45 |
| 35 | (A)-23 | (B)-47 |
| 36 | (A)-24 | (B)-48 |

The characteristics of each of the resulting photoreceptors were evaluated in the same manner as in Example 1. As a result, the surface smoothness and film strength of all the samples were almost equal to those of the sample of Example 1.

Further, each of the photoreceptors according to the present invention proved to have excellent charging properties, dark decay retention, and photosensitivity and provided a clear reproduced image free from background fog even when processed under severe conditions of high temperature and high humidity (30° C., 80% RH).

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a support having provided thereon at least one photoconductive layer containing at least inorganic photoconductive particles and a binder resin, wherein the binder resin comprises:

(A) at least one resin having a weight average molecular weight of from $1\times10^3$ to $2\times10^4$ with at least one substituent selected from the group consisting of (i) $-PO_3H_2$, (ii) $-SO_3H$, (iii) $-COOH$, (iv)

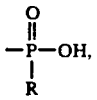

wherein R is a hydrocarbon group or —OR′, and R′ represents a hydrocarbon group, (v) —SH, (vi) a phenolic hydroxyl group, and (vii) a cyclic acid anhydride-containing group, the substituent being bonded to one of the terminals of the main chain thereof, Resin (A) containing from 0.5 to 15% by weight of acidic groups, and (B) at least one comb type copolymer resin comprising a monofunctional macromonomer and a monomer, said monofunctional macromonomer having a weight average molecular weight of not more than $2\times10^4$, said macromonomer containing at least one polymerization component represented by formula (b-2) or (b-3):

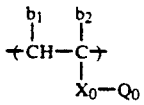

(b-2)

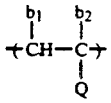

(b-3)

wherein $W_0$ is —COO—, —OCO—, —$CH_2$OCO—, —$CH_2$COO—, —O—, —$SO_2$— —CO—,

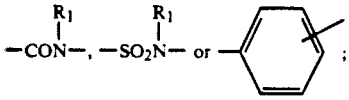

wherein $R_1$ is a hydrogen atom or a hydrocarbon group; $Q_0$ is an aliphatic group having 1 to 18 carbon atoms or an aromatic group having from 6 to 12 carbon atoms; $b_1$ and $b_2$, which may be the same or different, each is a hydrogen atom, a halogen atom, a cyano group, a hydrocarbon group, or —COO—Z or —COO—Z bonded via a hydrocarbon group, wherein Z is a hydrogen atom or a substituted or unsubstituted hydrocarbon group; and Q is —CN, —$CONH_2$ or

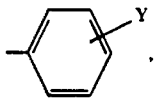

wherein Y is a hydrogen atom, a halogen atom, an akoxyl group or —COOZ', wherein Z' is an alkyl group, an aralkyl group or an aryl group, with a polymerizable double bond-containing group represented by formula (b-1) being bonded to only one of the terminals of the main chain thereof:

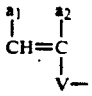

(b-1)

wherein V has the same meaning as $X_0$; and $a_1$ and $a_2$, which may be the same or different, each has the same meaning as $b_1$ and $b_2$, and said monomer is represented by formula (b-4):

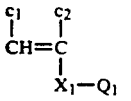

(b-4)

wherein $X_1$ has the same meaning as $X_0$; $Q_1$ has the same meaning as $Q_0$; and $c_1$ and $c_2$, which may be the same or different, each has the same meaning as $b_1$ and $b_2$.

2. An electrophotographic photoreceptor as claimed in claim 1, wherein said Resin (A) is a resin containing at least 30% by weight of at least one repeating unit represented by formula (a-1) or (a-2):

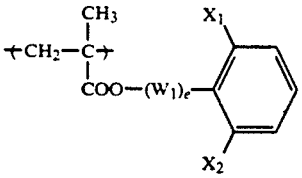

(a-1)

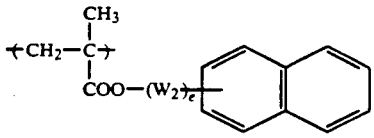

(a-2)

wherein $X_1$ and $X_2$, which may be the same or different, each is a hydrogen atom, a hydrocarbon group having from 1 to 10 carbon atoms, a chlorine atom, a bromine atom, —$COY_1$ or —$COOY_2$, wherein $Y_1$ and $Y_2$, which may be the same or different, each represents a hydrocarbon group having from 1 to 10 carbon atoms, provided that both $X_1$ and $X_2$ do not simultaneously represent a hydrogen atom; $W_1$ and $W_2$ each represents a linking group containing from 1 to 4 linking atoms which connects the —COO— and the benzene ring, and e is 0 to 1.

3. An electrophotographic photoreceptor as claimed in claim 1, wherein said Resin (A) is a polymer having at least one substituent selected from —$PO_3H_2$, —$SO_3H$, —COOH,

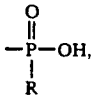

wherein R is a hydrocarbon group having from 1 to 10 carbon atoms or —OR', and R' represents a hydrocarbon group having from 1 to 10 carbon atoms, and a cyclic acid anhydride-containing group, the substituent being bonded to only one of the terminals of the polymer main chain.

4. An electrophotographic photoreceptor as claimed in claim 1, wherein said Resin (B) is a copolymer having at least one acidic group selected from the group consisting of (i) —$PO_3H_2$, (ii) —$SO_3H$, (iii) —COOH, (iv) —OH, (v) —SH, and (vi)

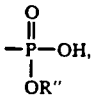

wherein R" represents a hydrocarbon group, the acidic group being bonded to only one of the terminals of the polymer main chain.

5. An electrophotographic photoreceptor as claimed in claim 1, wherein Resin (A) has a weight average molecular weight of from $3\times10^3$ to $1\times10^4$.

6. An electrophotographic photoreceptor as claimed in claim 1, wherein Resin (A) contains at least 30% by weight of at least one copolymerization component corresponding to a monomer represented by formula (a-3).

7. An electrophotographic photoreceptor as claimed in claim 1, wherein Resin (B) has a weight average molecular weight of from $5\times10^4$ to $3\times10^5$.

8. An electrophotographic photoreceptor as claimed in claim 1, wherein Macromonomer (M) has a weight average molecular weight of from $1\times10^3$ to $2\times10^4$.

9. An electrophotographic photoreceptor as claimed in claim 1, wherein the copolymerization ratio in Resin (B) of Macromonomer (M) to the monomer of formula (b-4) is 1 to 90/99 to 10 by weight.

10. An electrophotographic photoreceptor as claimed in claim 1, wherein the weight ratio of Resin (A) to Resin (B) is 5 to 80/95 to 20.

11. An electrophotographic photoreceptor as claimed in claim 1, wherein said photoconductive particles are zinc oxide particles.

* * * * *